US012064851B2

(12) United States Patent
Brosnan et al.

(10) Patent No.: US 12,064,851 B2
(45) Date of Patent: Aug. 20, 2024

(54) ABRASIVE ARTICLES AND METHODS FOR FORMING SAME

(71) Applicants: SAINT-GOBAIN ABRASIVES, INC., Worcester, MA (US); SAINT-GOBAIN ABRASIFS, Conflans-Sainte-Honorine (FR)

(72) Inventors: Maureen A. Brosnan, West Boylston, MA (US); Srikanth Rapaka, Natick, MA (US); Nilanjan Sarangi, Shrewsbury, MA (US); Charles W. Bleakney, IV, Northborough, MA (US); Craig M. Adams, Webster, MA (US); Run Toun, Worcester, MA (US)

(73) Assignees: SAINT-GOBAIN ABRASIVES, INC., Worcester, MA (US); SAINT-GOBAIN ABRASIFS, Conflans-Sainte-Honorine (FR)

( * ) Notice: Subject to any disclaimer, the term of this patent is extended or adjusted under 35 U.S.C. 154(b) by 37 days.

(21) Appl. No.: 17/809,744

(22) Filed: Jun. 29, 2022

(65) Prior Publication Data

US 2023/0001542 A1 Jan. 5, 2023

Related U.S. Application Data

(60) Provisional application No. 63/217,056, filed on Jun. 30, 2021.

(51) Int. Cl.
*B24D 3/04* (2006.01)
*B24D 3/34* (2006.01)

(52) U.S. Cl.
CPC ..... *B24D 3/04* (2013.01); *B24D 3/342* (2013.01)

(58) Field of Classification Search
CPC ..... B24D 3/04; B24D 3/342; C09K 3/1409
See application file for complete search history.

(56) References Cited

U.S. PATENT DOCUMENTS

| | | | |
|---|---|---|---|
| 5,145,908 | A | 9/1992 | Jenny et al. |
| 5,401,284 | A | 3/1995 | Sheldon et al. |
| 5,942,015 | A | 8/1999 | Culler et al. |
| 6,228,299 | B1 | 5/2001 | Janney et al. |
| 7,015,268 | B2 | 3/2006 | Manwiller et al. |

(Continued)

FOREIGN PATENT DOCUMENTS

| | | | |
|---|---|---|---|
| WO | 143919 | A1 | 7/2001 |
| WO | 2016210057 | A1 | 12/2016 |

OTHER PUBLICATIONS

Miao et al., "Modified Gel Casting Technique to Fabricate Honeycomb Structured Vitrified-Bonded Ultrafine Diamond Grinding Wheels", Ceramics International, Mar. 2020, pp. 4462-4469, vol. 46, Issue 4. <https://www.sciencedirect.com/science/article/pii/S0272884219330366>.

(Continued)

*Primary Examiner* — Pegah Parvini
(74) *Attorney, Agent, or Firm* — Abel Schillinger, LLP; Arpan Ghosh

(57) ABSTRACT

An abrasive article including a bonded abrasive body having a certain Homogeneity Factor and a multimodal distribution of abrasive particle sizes where the particles size of a first mode is no greater than 80% of a particle size of a second mode. The bonded body can also have a consistent hardness throughout the body.

16 Claims, 9 Drawing Sheets

(56) References Cited

U.S. PATENT DOCUMENTS

| | | | | |
|---|---|---|---|---|
| 7,407,145 | B2 | 8/2008 | Miyazawa et al. | |
| 7,517,490 | B2 | 4/2009 | Miyazawa | |
| 7,524,345 | B2 | 4/2009 | Nevoret et al. | |
| 8,888,878 | B2 | 11/2014 | Wang et al. | |
| 2001/0033038 | A1 | 10/2001 | Sakaguchi et al. | |
| 2010/0326894 | A1 | 12/2010 | Palmgren et al. | |
| 2014/0137482 | A1* | 5/2014 | Li | B24D 5/04 51/309 |
| 2014/0182214 | A1 | 7/2014 | Sivasubramanian et al. | |
| 2015/0267097 | A1* | 9/2015 | Rosenflanz | C09K 3/1409 451/28 |
| 2016/0332236 | A1 | 11/2016 | Stoyanov | |
| 2017/0297106 | A1 | 10/2017 | Myerberg et al. | |
| 2018/0104793 | A1 | 4/2018 | Franke et al. | |
| 2020/0001429 | A1 | 1/2020 | Rapaka et al. | |
| 2020/0001430 | A1* | 1/2020 | Rapaka | B24D 3/10 |
| 2020/0331120 | A1 | 10/2020 | Gorgan et al. | |

OTHER PUBLICATIONS

Lin Tao, "Vitrified Bond Diamond Grinding Wheel Prepared by Gel-Casting with 3D Printing Molds", Diamond & Related Materials, Oct. 2020, 107917, vol. 108, Elsevier, Beijing, China, <https://www.sciencedirect.com/science/article/abs/pii/S0925963520301783>.

Gilissen R. et al., "Gelcasting, a Near Net Shape Technique", Materials & Design, Aug. 1, 2000, pp. 251-257, vol. 21, Issue 4.

Yang Jinlong et al., "Recent Developments in Gelcasting of Ceramics,", Journal of the European Ceramic Society, Nov. 2011, pp. 2569-2591, vol. 31, Issue 14.

Chen et al., "Ceramics with Special Porous Structures Fabricated by Freeze-Gelcasting: Using Tert-Butyl Alcohol as a Template", Journal of the American Ceramic Society, Sep. 6, 2007, p. 3478-3484, vol. 90, Issue 11.

International Search Report for PCT/US2022/073259, dated Oct. 11, 2022, 2 pages.

* cited by examiner

ABRASIVE ARTICLES AND METHODS FOR FORMING SAME

BACKGROUND OF THE INVENTION

Field of the Disclosure

The present invention relates in general to abrasive articles, and in particular, to bonded abrasive articles having a bimodal distribution of abrasive particles.

Description of the Related Art

Abrasive articles used in machining applications typically include bonded abrasive articles and coated abrasive articles. A bonded abrasive article generally has a bond matrix containing abrasive particles. Bonded abrasive articles can be mounted onto a suitable machining apparatus and used in various applications, such as shaping, grinding, polishing, and cutting. The industry continues to demand improved abrasive tools to meet the needs of gear grinding.

BRIEF DESCRIPTION OF THE DRAWINGS

The present disclosure may be better understood, and its numerous features and advantages made apparent to those skilled in the art by referencing the accompanying drawings.

DETAILED DESCRIPTION

The following is generally directed to bonded abrasive articles suitable for use in material removal operations. The bonded abrasive articles can be used in various applications, including, for example, surface grinding, precision grinding operations (e.g., gear grinding operations), and the like. In one particular aspect, the abrasive article may include a bonded abrasive of a certain dimension and structure that has improved performance in foundry applications.

Reference herein to bonded abrasive articles includes reference to a three-dimensional volume of an abrasive material having abrasive particles contained within a volume of a bond material. Bonded abrasive articles can be distinct from coated abrasive articles that may utilize a single layer of abrasive particles contained in a layer of bond or adhesive material. Moreover, the bonded abrasive articles of embodiments herein may include some porosity within the three-dimensional volume of a bond material.

Figure 1:
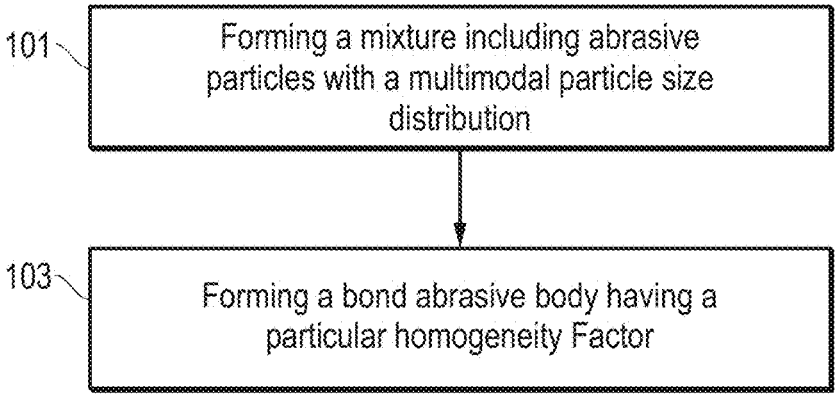
FIG. 1 includes a flow chart including a process for forming an abrasive article according to an embodiment.

FIG. 1 includes a flowchart for forming an abrasive article in accordance with an embodiment. As illustrated, the process for forming the abrasive article can begin at step 101 by forming a mixture that includes abrasive particles with a multimodal particle size distribution. The mixture can be a slurry, including a plurality of components homogeneously mixed in therein. In accordance with an embodiment, the process of forming the mixture can include providing a carrier material. A carrier material may be a liquid suitable for containing solid components therein. For example, in one particular embodiment, the carrier can include water; more particularly, it may consist essentially of water such as deionized water.

The process of forming the mixture may further include adding a bond precursor material to the carrier. A bond precursor material may be a material that becomes the bond material of the final-formed abrasive article. In accordance with an embodiment, the bond precursor material can include a powder material configured to form the bond material of the final-formed abrasive article. In one embodiment, the bond precursor material can include an inorganic material, such as, but not limited to, metals, metal alloys, ceramics, vitreous materials or frit materials, or any combination thereof. The bond precursor material may include inorganic material in an amorphous phase, polycrystalline phase, monocrystalline phase, or any combination thereof.

In accordance with one embodiment, the bond precursor material may be added in a particular content. For example, mixture may include at least 1 wt % of the bond precursor material for a total weight of the mixture, such as at least 2 wt % or at least 3 wt % or at least 4 wt % or at least 5 wt % or at least 6 wt % or at least 7 wt % or at least 8 wt % or at least 9 wt % or at least 10 wt % or at least 12 wt % or at least 14 wt % or at least 16 wt % or at least 18 wt % or at least 20 wt % or at least 22 wt % or at least 24 wt % or at least 26 wt % or at least 28 wt % or at least 30 wt %. Still, in one non-limiting embodiment, the mixture may include not greater than 30 wt % of the bond precursor material for a total weight of the mixture, such as not greater than 28 wt % or not greater than 25 wt % or not greater than 22 wt % or not greater than 20 wt % or not greater than 18 wt % or not greater than 15 wt % or not greater than 12 wt % or not greater than 10 wt % or not greater than 8 wt % or not greater than 5 wt % or not greater than 3 wt %. The mixture may include a content of the bond precursor material in an amount within a range, including any of the minimum and maximum percentages noted above.

In accordance with another embodiment, the process of forming a mixture can include adding a gelling agent to the mixture. The addition of the gelling agent to the mixture may be completed at various times, including, for example, prior to the addition of any dry components. The gelling agent may be a material that facilitates changing the mixture into a gel. A gelling agent may be used in combination with gelling processes, including, for example, the addition of heat, to facilitate the gelation process.

In accordance with an embodiment, the gelling agent may be an organic material, such as a gum. For example, the gelling agent may be selected from the group consisting of agar, agarose, xanthan gum, carboxy methyl cellulose, gellan gum, carrageenan gum, guar gum, tara gum, cellulose gum, locust bean gum, pectin, or any combination thereof. For example, the gelling agent may be a combination of agar and pectin; or a combination of gellan gum; or a combination of guar gum, and agarose; or a combination of gellan gum and xanthan gum; or a combination of cellulose gum, locust bean gum, or pectic.

For certain embodiments, the mixture may include a certain content of the gelling agent to facilitate the formation of an improved abrasive article. For example, the mixture may include at least 0.1 wt % of the gelling agent for a total weight of the mixture, such as at least 0.2 wt % or at least 0.5 wt % or at least 0.8 wt % or at least 1 wt % or at least 1.5 wt % or at least 2 wt % or at least 2.5 wt % or at least 3 wt % or at least 3.5 wt % or at least 4 wt % or at least 4.5 wt % or at least 5 wt % or at least 5.5 wt % or at least 6 wt % or at least 6.5 wt % or at least 7 wt % or at least 7.5 wt %. In one non-limiting example, the mixture may include not greater than 10 wt % of the gelling agent for a total weight of the mixture, such as not greater than 9 wt % or not greater than 8 wt % or not greater than 7 wt % or not greater than 6 wt % or not greater than 5 wt % or not greater than 4 wt % or not greater than 3 wt % or not greater than 2 wt % or not greater than 1 wt %. The mixture may include a content of the gelling agent in an amount within a range, including any of the minimum and maximum percentages noted above.

The mixture may further include abrasive particles configured to form the abrasive component of the final-formed abrasive article. The abrasive particles may be added to the mixture at various times, including, for example, after the addition of the bond precursor material to the mixture. Still, it will be appreciated, in other embodiments, the abrasive particles may be added in combination with one or more of the other components in the mixture, including, for example, but not limited to the gelling agent, the bond precursor material, or one or more additives. The abrasive particles may include a material such as from the group consisting of oxides, borides, nitrides, carbides, oxynitrides, oxycarbides, amorphous, monocrystalline, polycrystalline, superabrasive, or any combination thereof. In one particular embodiment, the abrasive particles can include alumina, and may consist essentially of alumina.

The mixture may include a certain content of abrasive particles to facilitate improved manufacturing and/or improved performance of the abrasive article. For example, in one embodiment, the mixture may include at least 20 wt % of the abrasive particles for a total weight of the mixture, such as at least 22 wt % or at least 24 wt % or at least 26 wt % or at least 28 wt % or at least 30 wt % or at least 35 wt % or at least 40 wt % or at least 45 wt % or at least 50 wt % or at least 55 wt % or at least 60 wt % or at least 65 wt % or at least 70 wt %. In another non-limiting embodiment, the mixture may include not greater than 80 wt % of the abrasive particles for a total weight of the mixture, such as not greater than 75 wt % or not greater than 70 wt % or not greater than 65 wt % or not greater than 60 wt % or not greater than 55 wt % or not greater than 50 wt % or not greater than 45 wt % or not greater than 40 wt % or not greater than 35 wt % or not greater than 30 wt %, such as not greater than 25 wt %. The mixture may include a content of the abrasive particles in an amount within a range, including any of the minimum and maximum percentages noted above.

Figure 3:
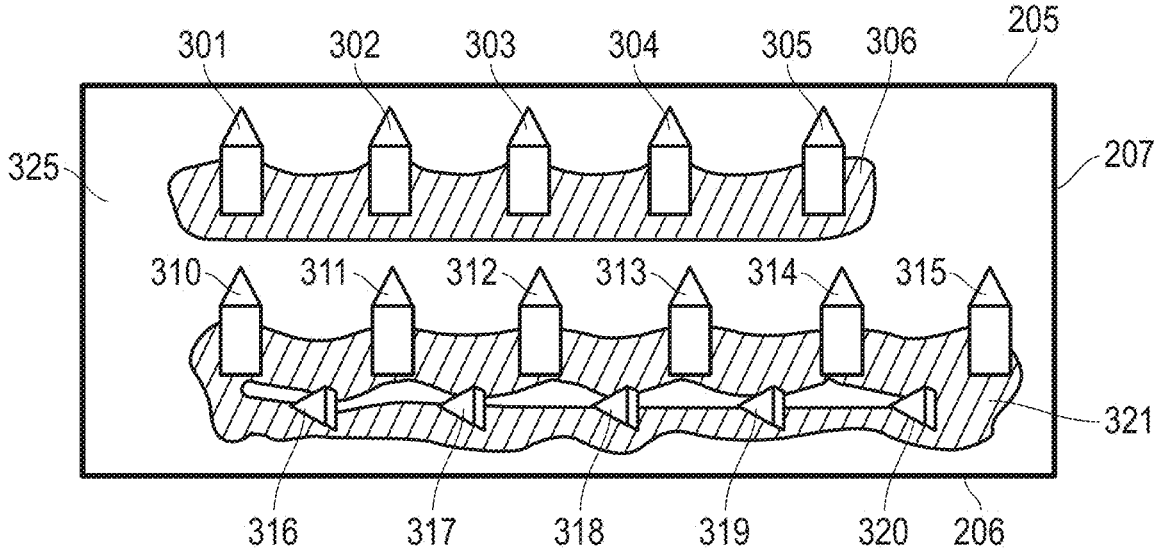
FIG. 3 includes an illustration of a portion of a fixed abrasive article, including abrasive particles in accordance with an embodiment.

In an embodiment, the abrasive particles in the mixture can have a multimodal particle size distribution. FIG. 3 includes a non-limiting example of a multimodal distribution. The particle size distribution can have a first mode, Sab1, corresponding to a first particle size and a second mode, Sab2, corresponding to a second particle size, where Sab1 is smaller than Sab2. The first mode can have a first height SabH1, and the second mode can have a second height SabH2. The distribution also includes a particle size SabAVG, equal to the average of Sab1 and Sab2 ((Sab1+Sab2)/2).

In an embodiment, the first mode Sab1 can be a particular particle size that may facilitate improved manufacturing and/or improved performance of the abrasive article. In an embodiment, Sab1 can be at least at least 5 microns or at least 10 microns or at least 15 microns or at least 20 microns or at least 25 microns or at least 30 microns or at least 35 microns or at least 40 microns or at least 45 microns or at least 50 microns or at least 55 microns or at least 60 microns. In another embodiment, Sab1 can be no greater than 150 microns or no greater than 140 microns or no greater than 130 microns or no greater than 120 microns or no greater than 110 microns or no greater than 100 microns or no greater than 95 microns or no greater than 90 microns or no greater than 85 microns or no greater than 80 microns or no greater than 75 microns or no greater than 70 microns or no greater than 65 microns or no greater than 60 microns or no greater than 55 microns. It will be appreciated that Sab1 can be between any of the minimum and maximum values noted above, including for example, but not limited to, at least 5 microns and no greater than 100 microns, at least 30 microns and no greater than 100 microns, or at least 25 microns and no greater than 120 microns.

In an embodiment, Sab2 can be a particular particle size that may facilitate improved manufacturing and/or improved performance of the abrasive article. In an embodiment, Sab2 can be at least 100 microns or at least 110 microns or at least 120 microns or at least 130 microns or at least 140 microns or at least 150 microns or at least 160 microns or at least 170 microns or at least 180 microns or at least 190 microns or at least 200 microns or at least 210 microns or at least 220 microns or at least 230 microns or at least 240 microns or at least 250 microns or at least 260 microns or at least 270 microns or at least 280 microns or at least 290 microns or at least 300 microns. In another embodiment, Sab2 can be no greater than 400 microns or no greater than 390 microns or no greater than 380 microns or no greater than 370 microns or no greater than 360 microns or no greater than 350 microns or no greater than 340 microns or no greater than 330 microns or no greater than 320 microns or no greater than 310 microns or no greater than 300 microns or no greater than 290 microns or no greater than 280 microns or no greater than 270 microns or no greater than 260 microns or no greater than 250 microns or no greater than 240 microns or no greater than 230 microns or no greater than 220 microns or no greater than 210 microns or no greater than 200 microns. It will be appreciated that Sab2 can be between any of the minimum and maximum values noted above, including for example, but not limited to, at least 130 microns and no greater than 340 microns, at least 200 microns and no greater than 360 microns, or at least 190 microns and no greater than 350 microns.

In an embodiment, the abrasive particle size distribution of the mixture can have a first mode Sab1 relative to the second mode Sab2 that may facilitate improved manufacturing and/or performance of the abrasive article. In an embodiment, Sab1 can be no greater than 80% of Sab2 (Sab1<0.8*Sab2), or no greater than 75% or no greater than 70% or no greater than 65% or no greater than 60% or no greater than 55% or no greater than 50% or no greater than 45% or no greater than 40% or no greater than 35% or no greater than 30% or no greater than 25% or no greater than 20% of Sab2. In another embodiment Sab1 can be at least 1% of Sab2, at least 2% or at least 3% or at least 4% or at least 5% or at least 6% or at least 8% or at least 10% or at least 12% or at least 14% or at least 16% or at least 18% or at least 20% or at least 25% or at least 30% or at least 35% or at least 40% of Sab2. It will be appreciated that the particle size of Sab1 relative to Sab2 may be between any of the minimum and maximum values noted above, including, for example but not limited to at least 1% and no greater than 70%, at least 5% and no greater than 20%, or at least 2% and no greater than 40%.

In an embodiment, the abrasive particle size distribution of the mixture can have a difference between Sab1 and Sab2 (Sab2−Sab1) that may facilitate improved manufacturing and/or performance of the abrasive article. In an embodiment, the difference between Sab1 and Sab2 can be at least 10 microns or at least 15 microns or at least 20 microns or at least 25 microns or at least 30 microns or at least 35 microns or at least 40 microns or at least 45 microns or at least 50 microns or at least 55 microns or at least 60 microns or at least 65 microns or at least 70 microns or at least 75 microns or at least 80 microns or at least 85 microns or at least 90 microns or at least 95 microns or at least 100 microns or at least 105 microns or at least 110 microns or at least 115 microns or at least 120 microns or at least 125 microns or at least 130 microns or at least 135 microns or at least 140 microns or at least 145 microns or at least 150 microns or at least 155 microns or at least 160 microns or at least 165 microns or at least 170 microns or at least 175 microns or at least 180 microns or at least 185 microns or at least 190 microns or at least 195 microns or at least 200 microns. In another embodiment, the difference between Sab1 and Sab2 can be no greater than 300 microns or no greater than 295 microns or no greater than 290 microns or no greater than 285 microns or no greater than 280 microns or no greater than 275 microns or no greater than 270 microns or no greater than 265 microns or no greater than 260 microns or no greater than 255 microns or no greater than 250 microns or no greater than 245 microns or no greater than 240 microns or no greater than 235 microns or no greater than 230 microns or no greater than 225 microns or no greater than 220 microns or no greater than 215 microns or no greater than 210 microns or no greater than 205 microns or no greater than 200 microns. It will be appreciated that the difference between Sab1 and Sab2 can be between any of the minimum and maximum values noted above, including, for example, but not limited to, at least 90 microns and no greater than 250 microns, at least 100 microns and no greater than 240 microns, or at least 90 microns and no greater than 230 microns.

In an embodiment, the particle size distribution of the mixture can have a SabAVG that may facilitate improved manufacturing and/or performance of the abrasive article. In an embodiment, SabAVG can be at least 90 microns, or at least 100 microns or at least 110 microns or at least 120 microns or at least 130 microns or at least 140 microns or at least 150 microns or at least 160 microns or at least 170 microns or at least 180 microns or at least 190 microns or at least 200 microns or at least 210 microns or at least 220 microns or at least 230 microns or at least 240 microns or at least 250 microns. In another embodiment, SabAVG can be no greater than 250 microns or no greater than 240 microns or no greater than 230 microns or no greater than 220 microns or no greater than 210 microns or no greater than 200 microns or no greater than 190 microns or no greater than 180 microns or no greater than 170 microns or no greater than 160 microns or no greater than 150 microns or no greater than 140 microns or no greater than 130 microns or no greater than 120 microns or no greater than 110 microns or no greater than 100 microns. It will be appreciated that SabAVG may be between any of the minimum and maximum values noted above, including for example but not limited to at least 90 microns and no greater than 250 microns, at least 100 microns and no greater than 240 microns, or at least 150 microns and no greater than 240 microns.

In an embodiment, the particle size distribution of the mixture can have a ratio of SabH1/SabH2 that may facilitate improved manufacturing and/or performance of the abrasive article. In an embodiment, SabH1/SabH2 can be at least 0.75 or at least 0.8 or at least 0.85 or at least 0.9 or at least 0.95 or at least 1 or at least 1.05 or at least 1.1 or at least 1.15 or at least 1.2 or at least 1.25 or at least 1.3 or at least 1.35 or at least 1.4 or at least 1.45 or at least 1.5. In another embodiment SabH1/SabH2 can be no greater than 10 or no greater than 9.5 or no greater than 9 or no greater than 8.5 or no greater than 8 or no greater than 7.5 or no greater than 7 or no greater than 6.5 or no greater than 6 or no greater than 5.5 or no greater than 5. It will be appreciated that SabH1/SabH2 may be between any of the minimum and maximum values noted above, including, for example, but not limited to at least 0.75 and no greater than 10, at least 1 and no greater than 8, or at least 0.9 and no greater than 6.

The abrasive particles of the first set of abrasive particles may have various compositions, shapes, sizes, and other features. For example, the abrasive particles may include an abrasive particle type such as from the group of claimed unagglomerated particles, agglomerated particles, shaped abrasive particles, shaped abrasive composites, constant thickness abrasive particles (CTAP), randomly shaped abrasive particles, or any combination thereof. In another embodiment, the abrasive particles may include a material such as from the group of oxides, borides, nitrides, carbides, oxynitrides, oxycarbides, amorphous, monocrystalline, polycrystalline, superabrasive, or any combination thereof. In one particular embodiment, the first set of abrasive particles can include alumina, and may consist essentially of alumina.

The abrasive particles of the second set of abrasive particles may have various compositions, shapes, sizes, and other features. For example, the abrasive particles may include an abrasive particle type such as from the group of claimed unagglomerated particles, agglomerated particles, shaped abrasive particles, shaped abrasive composites, constant thickness abrasive particles (CTAP), randomly shaped abrasive particles, or any combination thereof. In another embodiment, the abrasive particles may include a material such as from the group of oxides, borides, nitrides, carbides, oxynitrides, oxycarbides, amorphous, monocrystalline, polycrystalline, superabrasive, or any combination thereof. In one particular embodiment, the second set of abrasive particles can include alumina, and may consist essentially of alumina.

In an embodiment, the mixture can contain a first set of abrasive particles having a particle size of at least SabAVG and a wt % Wab1 relative to the total weight of abrasive particles and a second set of abrasive particles having a particle size of no greater than SabAVG microns and a wt % Wab2 relative to the total weight of abrasive particles. In an embodiment, the mixture can have a particular Wab1 that may facilitate improved manufacturing and/or performance of the abrasive article. In an embodiment, Wab1 can be at least 1% or at least 1.25% or at least 1.5% or at least 1.75% or at least 2% or at least 2.25% or at least 2.5% or at least 2.75% or at least 3% or at least 3.25% or at least 3.5% or at least 4% or at least 5% or at least 6% or at least 7% or at least 8% or at least 9%. In another embodiment, Wab1 can be no greater than 50% or no greater than 45% or no greater than 40% or no greater than 35% or no greater than 30% or no greater than 25% or no greater than 20% or no greater than 15%. It will be appreciated that Wab1 can be between any of the minimum and maximum values noted above, including for example, but not limited to, at least 1% and no greater than 50%, at least 1.25% and no greater than 40%, or at least 2.5% and no greater than 35%.

In an embodiment, the mixture can have a particular Wab2 that may facilitate improved manufacturing and/or performance of the abrasive article. In an embodiment Wab2 can at least 50% or at least 55% or at least 60% or at least 65% or at least 70% or at least 75% or at least 80% or at least 85% or at least 90% or at least 91% or at least 92 or at least 93% or at least 94% or at least 95% or at least 96% or at least 97% or at least 98% or at least 99%. In another embodiment, Wab2 can be no greater than 99.9% or no greater than 99.5% or no greater than 99% or no greater than 98% or no greater than 97% or no greater than 96% or no greater than 95% or no greater than 94% or no greater than 93% or no greater than 92% or no greater than 91% or no greater than 90%. It will be appreciated that Wab2 can be between any of the minimum and maximum values noted above, including for example, but not limited to, at least 50% and no greater than 99.9%, at least 80% and no greater than 95%, or at least 85% and no greater than 99.5%.

In an embodiment, the mixture can have a particular ratio of Wab1 to Wab2 that may facilitate improved manufacturing and/or performance of the abrasive article. In an embodiment, Wab1/Wab2 can be at least 0.020 or at least 0.021 or at least 0.022 or at least 0.023 or at least 0.024 or at least 0.025 or at least 0.026 or at least 0.027 or at least 0.028 or at least 0.029 or at least 0.03 or at least 0.04 or at least 0.05 or at least 0.060 or at least 0.07. In another embodiment, Wab1/Wab2 can be no greater than 2 or no greater than 1 or no greater than 0.9 or no greater than 0.8 or no greater than 0.7 or no greater than 0.6 or no greater than 0.5 or no greater than 0.4 or no greater than 0.3 or no greater than 0.2 or no greater than 0.1. It will be appreciated that Wab1/Wab2 can be between any of the minimum and maximum values noted above, including, for example, but not limited to, at least 0.020 and no greater than 0.1, at least 0.025 and no greater than 0.4, or at least 0.03 and no greater than 0.2.

In an embodiment, the mixture can contain a first set of abrasive particles having a particle size of at least SabAVG and a number of particles Nab1 and a second set of abrasive particles having a particle size of no greater than SabAVG microns and a number of particles Nab2. In an embodiment, Nab1/Nab2 can be at least 0.75 or at least 0.8 or at least 0.85 or at least 0.9 or at least 0.95 or at least 1 or at least 1.05 or at least 1.1 or at least 1.15 or at least 1.2 or at least 1.25 or at least 1.3 or at least 1.35 or at least 1.4 or at least 1.45 or at least 1.5. In another embodiment, Nab1/Nab2 can be no greater than 10 or no greater than 9.5 or no greater than 9 or no greater than 8.5 or no greater than 8 or no greater than 7.5 or no greater than 7 or no greater than 6.5 or no greater than 6 or no greater than 5.5 or no greater than 5. It will be appreciated that Nab1/Nab2 may be between any of the minimum and maximum values noted above, including, for example, but not limited to at least 0.75 and no greater than 10, at least 1 and no greater than 8, or at least 0.9 and no greater than 6.

The mixture may further include one or more additives which may facilitate improved manufacturing and/or performance of the abrasive article. Some exemplary additives may include, but are not limited to, dispersants, surfactants, cationic agents, or any combination thereof. As used herein, a dispersant may prevent flocculation of the mixture by electrostatic or steric repulsion. As used herein, a surfactant may lower the surface tension between two liquids, a solid and liquid or a gas and liquid. As used herein, a cationic agent may be an ionic compound (e.g., a salt) that cross-links with the gelling agent, which may be an anionic material.

The one or more additives may be added to the mixture at various times, including, for example, after the addition of the solid components to the mixture, including, for example, the bond precursor material and the abrasive particles. Still, it will be appreciated, in other embodiments, the one or more additives may be added in combination with one or more of the other components in the mixture, including for example, but not limited to the gelling agent, the bond precursor material, or one or more additives. The order the additives are added may also be significant to facilitate suitable formation of the abrasive article. For example, in at least one embodiment, the cationic agent may be added after any other additives are added to the mixture.

The dispersant can include at least one of sodium polyacrylate (e.g., Darvan 811), copolymer with pigment affinic group (e.g., BYK192), ammonium polymeta acrylate (e.g., Darvan C-N), ammonium polyacrylate (e.g., Darvan 821A), polyacrylic acid, ammonium salt in an acrylic polymer in water (e.g., Dispex), citric acid, sodium dodecylbenzenesulfonate, cetyltrimethyl ammonium bromide or any combination thereof.

The mixture may include a particular content of dispersant to facilitate improved manufacturing and/or performance of the abrasive article. For example, the mixture can include at least 0.1 wt % of the dispersant for a total weight of the mixture, such as at least 0.2 wt % or at least 0.5 wt % or at least 0.8 wt % or at least 1 wt % or at least 1.5 wt % or at least 2 wt % or at least 2.5 wt % or at least 3 wt % or at least 3.5 wt % or at least 4 wt % or at least 4.5 wt % or at least 5 wt %. In another non-limiting embodiment, the mixture may include not greater than 6 wt % of the dispersant for a total weight of the mixture, such as not greater than 5 wt % or not greater than 4 wt % or not greater than 3 wt % or not greater than 2 wt % or not greater than 1 wt %. The mixture may include a content of the dispersant in an amount within a range, including any of the minimum and maximum percentages noted above.

Suitable examples of surfactants can include inorganic materials, organic materials, or a combination thereof. A suitable surfactant may include a sulfate, a sarconsinate, a laurate, a stearate, lecithin, and the like. In one particular embodiment, the surfactant can include sodium lauroyl sarconsinate, sodium laurel sulfate, sodium laurate, sodium stearate, sodium alkyl sulfate, sodium dodecyl sulfate, sorbitan, polyethylene glycol, polysorbate, glycerol monostearate, egg lecithin, or any combination thereof.

The mixture may include a particular content of surfactant that may facilitate improved manufacturing and/or performance of the abrasive article. For example, the mixture can include at least 0.1 wt % of the surfactant for a total weight of the mixture, such as at least 0.2 wt % or at least 0.5 wt % or at least 0.8 wt % or at least 1 wt % or at least 1.5 wt % or at least 2 wt % or at least 2.5 wt % or at least 3 wt % or at least 3.5 wt % or at least 4 wt % or at least 4.5 wt % or at least 5 wt %. In another non-limiting embodiment, the mixture may include not greater than 6 wt % of the surfactant for a total weight of the mixture, such as not greater than 5 wt % or not greater than 4 wt % or not greater than 3 wt % or not greater than 2 wt % or not greater than 1 wt %. The mixture may include a content of the surfactant in an amount within a range, including any of the minimum and maximum percentages noted above.

Some suitable examples of cationic agents can include inorganic compounds, particularly salts, such as sulfates, chlorides, chromates, nitrates, carbonates (e.g., bicarbonates), hydrates, and the like. In particular instances, the cationic agent may include a compound including an alkali element, alkali earth element, transition metal element, hydrogen, or a combination thereof. More particularly, the cationic agent may include a compound including sodium, potassium, lithium, ammonium, copper, magnesium, iron, calcium, or any combination thereof. In one particular embodiment, the cationic agent is preferably calcium chloride or sodium chloride. For example, the cationic agent may consist of calcium chloride or sodium chloride.

The cationic agent may be added to the mixture at various times, including, for example, after the addition of the solid components (e.g., abrasive particles, one or more fillers, bond precursor mixture) to the mixture. In one particular embodiment, the cationic agent may be the last component added to the slurry prior to gelation. Still, it will be appreciated, in other embodiments, the cationic agent may be added in combination with one or more of the other components in the mixture, including, for example, but not limited to the gelling agent, the bond precursor material, abrasive particles or one or more additives.

The mixture may include a particular content of cationic agent that may facilitate improved manufacturing and/or performance of the abrasive article. For example, the mixture can include at least 0.1 wt % of the cationic agent for a total weight of the mixture, such as at least 0.2 wt % or at least 0.5 wt % or at least 0.8 wt % or at least 1 wt % or at least 1.5 wt % or at least 2 wt % or at least 2.5 wt % or at least 3 wt % or at least 3.5 wt % or at least 4 wt % or at least 4.5 wt % or at least 5 wt %. In another non-limiting embodiment, the mixture may include not greater than 6 wt % of the cationic agent for a total weight of the mixture, such as not greater than 5 wt % or not greater than 4 wt % or not greater than 3 wt % or not greater than 2 wt % or not greater than 1 wt %. The mixture may include a content of the cationic agent in an amount within a range, including any of the minimum and maximum percentages noted above.

The method of forming the mixture may include continuous mixing while the one or more components are added. In particular, mixing may continue throughout the process of adding the components. In certain instances, the components may be added in a particular order, for example, the gelling agent may be added first, followed by the addition of the bond precursor material and abrasive particles. One or more of the additives such as the dispersant, surfactant, and cationic age may be added before or after the addition of the bond precursor material and/or abrasive particles. In a particular embodiment, the cationic agent can be added last of all the components. In another embodiment, a mixer may be used to aid mixing, such as a shear mixer, a ball mill, or any combination thereof. In an aspect, a shear mixer can be a high-shear mixer, or a low-shear mixer. In a particular aspect, to aid mixing, a shear rate may be at least 500 $S^{-1}$, at least 700 $S^{-1}$, at least 800 $S^{-1}$, or at least 900 $S^{-1}$. In another particular aspect, a shear rate may be at most 1200 $S^{-1}$, at most 1100 $S^{-1}$, or at most 1000 $S^{-1}$. It is to be understood, the shear rate can be within a range, including any of the minimum and maximum values noted herein. For example, a suitable shear rate can be from 500 $S^{-1}$ to 1200 $S^{-1}$.

In at least one embodiment, the method of making the abrasive article includes changing the mixture to a gel. The gelling of the mixture can be facilitated by the addition of one or more of the components, including, for example, the gelling agent and/or one or more additives. In accordance with one particular embodiment, the process of forming the mixture into a gel can include forming a mixture first, including the gel and the carrier, such as water. After forming the mixture, including the gel and water, the process may continue by adding at least one of a bond precursor material, abrasive particles, and one or more additives, or any combination thereof. After adding the bond precursor material, abrasive particles, and/or one or more additives to the mixture, the process can continue by adding the cationic agent to the mixture. In particular instances, the cationic agent may be added in the final step of forming the mixture prior to forming the mixture into a gel.

The process of forming the gel can include hydrating the gel. In a particular embodiment, the process of forming the gel can be a process of hydrating the gel. In particular, the process of forming the gel can include heating the mixture to a gelling temperature. More particularly, the mixture can be mixed while heating the mixture to the gelling temperature. In at least one embodiment, the gelling temperature can be at least 50° C., such as at least 60° C. or at least 70° C. or at least 80° C. or at least 90° C. or at least 100° C. Still, in one non-limiting embodiment, the gelling temperature may be not greater than 100° C., such as not greater than 90° C. or not greater than 80° C. or not greater than 70° C. It will be appreciated that the gelling temperature can be within a range, including any of the minimum and maximum temperatures noted above.

After forming the gel, which may also be referred to herein as a foamed gel, the process can continue by forming a green body from the gel. In accordance with an embodiment, the process of forming the green body can include at least one process from the group of pressing, molding, casting, drying, freezing, cooling, or any combination thereof. In one particular embodiment, the process of forming the green body can include casting. Casting can be completed by pouring the gel into a production tool or cast of a suitable shape and size. During the process of forming the green body, some of the gel may still be forming. That is, gelation need not necessarily be completed during the forming of the green body. Still, in certain instances, it may be desirable that the mixture is entirely gelled prior to the process of forming the green body. As used herein, reference to a gel includes a solid self-supporting structure that includes water contained in an integrated network defined by the solid particles in the gel. The gel may have a particular yield stress, such that it is self-supportive. For example, the gel can have a yield stress of at least 30 Pa, such as at least 60 Pa or at least 130 Pa.

In particular implementations, the process of forming the green body can include de-airing during the forming of the green body. For example, de-airing may be conducted during molding to remove bubbles.

After the green body has been formed, further processes may be conducted on the green body to change or convert the green body into a bonded abrasive body. After completing step 101, the process may continue at step 103 by forming a bonded abrasive body having a certain Homogeneity Factor. For example, one or more processes for converting the green body into the final-formed bonded abrasive body can include drying, sintering, cooling, pressing, vitrifying, or any combination thereof. In one particular embodiment, the process can include casting, cooling, drying, and firing. In the context of a vitrified bond material, the firing conditions can be suitable for forming a vitreous bond material. For example, the firing temperature can be at least 800° C. or at least 900° C. or at least 1000° C. or at least 1100° C. or at least 1200° C. Still, in one embodiment, the firing temperature can be not greater than 1400° C. or not greater than 1300° C. or not greater than 1200° C. or not greater than 1100° C. or not greater than 1000° C. or not greater than 900° C.

The final-formed abrasive article may be a bonded abrasive body defining an interconnected network of bond material that contains abrasive particles in the three-dimensional volume (i.e., matrix) of the bond material. Furthermore, the bonded abrasive body may have an amount of porosity distributed throughout the body and defining a phase that is distinct from the phases of the bond material and abrasive particles.

Bonded abrasive bodies formed by the processes of the embodiments herein may have particular features. For example, the bonded abrasive bodies may have relatively larger dimensions compared to most conventional bonded abrasive bodies and may further have relatively larger abrasive grit contained therein, which may be particularly suited for use in large-scale cutting and grinding operations, such as the foundry industry.

Figure 2A:
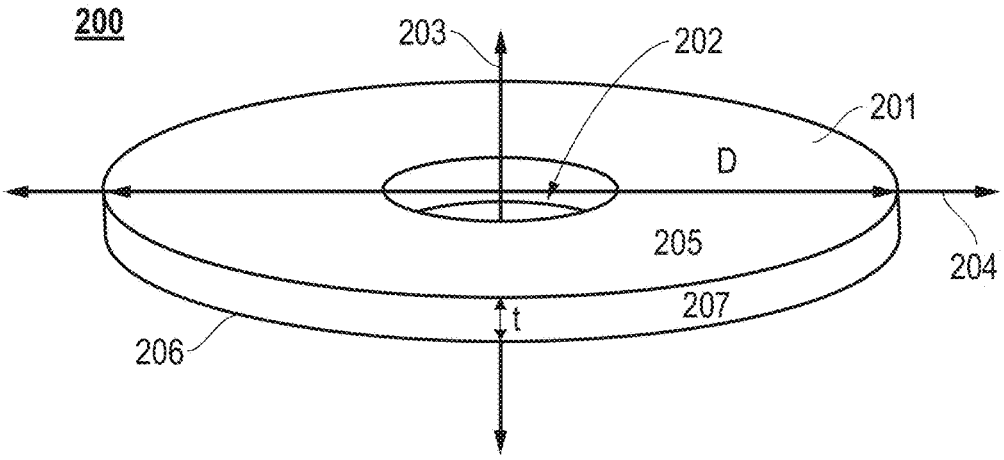
FIG. 2A includes a perspective-view illustration of an abrasive article according to an embodiment.

FIG. 2A includes a perspective view image of a bonded abrasive body in accordance with an embodiment. The abrasive article 200 can include a bonded abrasive body 201. The bonded abrasive body 201 can include an arbor hole 202 configured to engage with a spindle of a grinding machine for rotation of the abrasive article 200 relative to a workpiece. As further illustrated in FIG. 2A, the bonded abrasive body includes an axial axis 203 defining an axial direction and a lateral axis 204 defining an axis in a radial direction. The axial axis 203 extends in the vertical direction as defined by a thickness (t) of the bonded abrasive body 201. The lateral axis 204 extends in a radial direction defining the radius or diameter (D) of the bonded abrasive body 201. The body may have a first major surface 205, a second major surface 206 opposite the first major surface and separated by thickness t, and a side surface 207 extending between the first major surface and the second major surface.

Figure 2B:
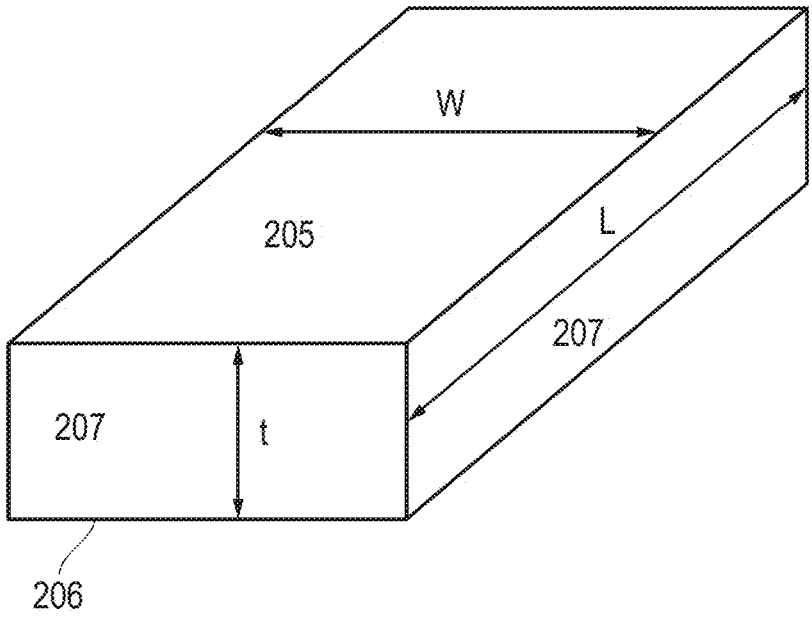
FIG. 2B includes a perspective-view illustration of an abrasive article according to an embodiment.

FIG. 2B includes a perspective view image of a bonded abrasive body in accordance with a different embodiment. The abrasive article 200 can include a bonded abrasive body 201. The body can include a length (L), a width (W), and a thickness (t), where the thickness (t) is the shortest dimension. The body may have a first major surface 205, a second major surface 206 opposite the first major surface and separated by thickness t, and side surfaces 207 extending between the first major surface and the second major surface.

In an embodiment, the bonded abrasive body 201 can further include an orientation structure that may control the placement or orientation of the abrasive particles within the bonded abrasive body. FIG. 3 includes an illustration of a portion of a bonded abrasive article, as viewed in a cross-sectional plane that is parallel to an axial plane of the article, in accordance with an embodiment. The body 201 (of FIG. 2B) can include abrasive particles 301, 302, 303, 304, and 305 (301-305), which may be coupled to each other by an orientation structure 306. It will be appreciated that at least the abrasive particle 305 can intersect the first major surface 205 of the body 201 and may be at least partially protruding from the volume of the body 201 and extending axially beyond first major surface 205. The abrasive particles 301-305 may be positioned relative to first major surface 205 and configured to conduct initial material removal operations using first major surface 205 as the working surface of the abrasive article. In accordance with an embodiment, the orientation structure 306 can define a structure coupling at least a portion of the abrasive particles to each other within the body 201. In certain instances, the orientation structure 306 can be coupled to a majority of the abrasive particles, which may include shaped abrasive particles and/or elongated abrasive particles.

In at least one embodiment, the orientation structure 306 can be a separate phase from the bond material 325. In accordance with an embodiment, at least a portion of the abrasive particles, including, for example, abrasive particles 301-305, may be coupled to the orientation structure 306 that extends throughout a portion of the bond material 325 within the body 201. In certain instances, the orientation structure 306 can have a different composition compared to the bond material 325. Notably, the orientation structure 306 can be a material that defines a separate phase of material from the bond material 325. In accordance with an embodiment, the orientation structure 306 can include a material such as a metal, ceramic, glass, an organic material, a polymer, and a combination thereof.

In certain instances, the orientation structure 306 may extend throughout the entire volume of the body 201. In other instances, the orientation structure 306 may extend for at least a majority of the total volume of the body 201. In still another embodiment, the orientation structure 306 may extend throughout at least a portion of the body 201, which may be greater or less than a majority of the entire volume of the body 201. In particular instances, the orientation structure 306 can be coupled to the abrasive particles and configured to control the three-axis position, including, for example, the predetermined position and/or predetermined rotational orientation of the abrasive particles within the body 201. For example, the orientation structure 306 can be coupled to the abrasive particles 301-305 and configured to control the predetermined position and predetermined rotational orientation, including the predetermined tilt angle, of the abrasive particles 301-305 relative to first major surface 205.

For at least one embodiment, the orientation structure 306 may have a particular hardness relative to the hardness of the bond material 325, which may facilitate certain material removal operations. For example, the orientation structure 306 can have a hardness that is less than a hardness of the bond material 325. Still, in accordance with another embodiment, the orientation structure 306 can have a hardness that is greater than a hardness of the bond material 325. In yet another construction, the orientation structure 306 can have a hardness that is substantially the same as a hardness of the bond material 325. As used herein, substantially the same is a reference to two values that are within 5% of each other based on the larger value.

In another embodiment, the orientation structure 306 may have a particular hardness with respect to the abrasive particles, including abrasive particles 301-305. For example, in at least one embodiment, the orientation structure 306 can have a hardness is less than a hardness of the abrasive particles 301-305. The relative hardness of the orientation structure 306 to the abrasive particles 301-305 may be suited to facilitate improved grinding performance. Still, in certain instances, the orientation structure 306 can have a hardness that is substantially the same as the hardness of the abrasive particles.

The orientation structure 306 can be coupled to the abrasive particles and configured to control the predetermined position of the abrasive particles within the volume of the body 201, which may include a radial position, an axial position, and an angular position of the abrasive particles in the body 201. In another embodiment, the orientation structure 306 can be coupled to each of the abrasive particles, including shaped abrasive particles and/or elongated abrasive particles throughout the body 201.

In accordance with another embodiment, the orientation structure 321 can be coupled to various groups of abrasive particles, including a first group of abrasive particles 310, 311, 312, 313, 314, and 315 (310-315) and a second group of abrasive particles 316, 317, 318, 319, and 320 (316-320). As illustrated, the first group of abrasive particles 310-315 can include abrasive particles positioned in a first radial plane and the second group of abrasive particles 316-320 can include abrasive particles positioned in a second radial plane. As illustrated herein, the orientation structure 321 can extend between groups of abrasive particles, including abrasive particles 310-315 and 316-320 and bind them to each other. In accordance with an embodiment, the orientation structure 321 can have various shapes and constructions, including for example, a web, woven material, a nonwoven material, paper, fabric, a spun woven material, a film, a laminate, a composite, and a preform having regions sized and shaped to contain one or more abrasive particles, including a shaped abrasive particle and/or elongated abrasive particle.

In another embodiment, the body 201 may include a first orientation structure, such as orientation structure 306, coupled to a first group of abrasive particles 301-305, and a second orientation structure, such as orientation structure 321, different than the first orientation structure 306 and coupled to the second group of abrasive particles 310-320. In accordance with an embodiment, the first orientation structure 306 can be coupled to the first group of abrasive particles 301-305 positioned in a first radial plane within the body 201 and the second orientation structure 321 can be coupled to a second group of abrasive particles 310-320 positioned in a second radial plane within the body 201. More particularly, it will be appreciated that the first orientation structure may be coupled to a first radial set of abrasive particles within a radial plane and the second orientation structure can be coupled to a second radial set of abrasive particles within a second radial plane of the body. It will be appreciated that the first and second radial planes can be distinct from each other as described herein.

In an alternative embodiment, various orientation structures may be used and coupled to abrasive particles of different portions of abrasive particles within the body including, for example, different axial collections of abrasive particles and/or different axial sets of abrasive particles. For example, in an embodiment, a first orientation structure may be coupled to a group of abrasive particles in a first axial plane associated with a first axial collection and a second orientation structure can be coupled to a second axial collection of abrasive particles within a second axial plane. Still, a single axial plane may utilize a plurality of orientation structures to couple one or more axial collections of abrasive particles therein.

In a further embodiment, the abrasive particles within the axial plane depicted in FIG. 3, namely particles 301-305, 311-315, and 316-320, can be arranged in a controlled distribution relative to each other. For example, the controlled distribution can include (a) an ordered distribution of the abrasive particles 301-305 relative to each other; (b) an ordered distribution of the abrasive particles 311-315 relative to each other; and/or (c) an ordered distribution of the abrasive particles 316-320 relative to each other. In another embodiment, the abrasive particles 301-305, 311-315, and 316-320 within the axial plane can be in a controlled, non-shadowing arrangement. For example, each of the depicted particles in FIG. 3 can be intentionally staggered relative to one another, such that each of the particles within the axial plane occupies a different radial position (e.g., a different distance from the center of the body 201). That is, when the particles are viewed top-down in the body 201 (e.g., viewed from a plane parallel to the major surfaces 205 or 206), the particles in one radial plane of the body 201 (e.g., the particles 301-305) do not directly overlie the particles in another radial plane of the body 201 (e.g., either the particles 311-315 or the particles 316-320). Furthermore, the particles in one radial plane of the body 201 also may have different rotational orientations (e.g., different predetermined tilt angles, different predetermined vertical rotational orientation angles, different predetermined lateral axis rotational orientation angles, and/or different rake angles) relative to one another or relative to the particles in another radial plane of the body 201.

According to one embodiment, the bonded abrasive body may have a diameter (D) of at least 260 mm, such as a diameter of at least 270 mm or at least 280 mm or at least 290 mm or at least 300 mm or at least 325 mm or at least 350 mm or at least 375 mm or at least 400 mm or at least 425 mm or at least 450 mm or at least 475 mm or at least 500 mm or at least 525 mm or at least 550 mm or at least 575 mm. Still, in one non-limiting embodiment, the bonded abrasive body may have a diameter (D) of not greater than 800 mm or not greater than 700 mm or not greater than 600 mm or not greater than 575 mm or not greater than 550 mm or not greater than 525 mm or not greater than 500 mm or not greater than 475 mm or not greater than 450 mm or not greater than 425 mm or not greater than 400 mm or not greater than 375 mm or not greater than 350 mm or not greater than 325 mm or not greater than 300 mm or not greater than 290 mm or not greater than 280 mm. It will be appreciated that the diameter (D) can be within a range, including any of the minimum and maximum values noted above. Reference herein to a diameter may be an average diameter of the bonded abrasive body, which is averaged from multiple measurements.

In another embodiment, the bonded abrasive body 201 may have a particular volume depending upon the application. For example, the volume of the bonded abrasive body 201 can be at least 1 $cm^3$. In other instances, the volume of the bonded abrasive body 201 can be at least 10 $cm^3$ or at least 20 $cm^3$ or at least 30 $cm^3$ or at least 50 $cm^3$ or at least 75 $cm^3$ or at least 100 $cm^3$. Still, in another non-limiting embodiment, the body may have a volume of not greater than 1000 $cm^3$ or not greater than 900 $cm^3$ or not greater than 800 $cm^3$ or not greater than 700 $cm^3$ or not greater than 600 $cm^3$ or not greater than 500 $cm^3$. It will be appreciated that the volume of the bonded abrasive body can be within a range including any of the minimum and maximum values noted above, such as a volume of at least 10 $cm^3$ to not greater than 1000 $cm^3$.

In still another embodiment, the bonded abrasive body 201 may have a particular thickness (t) configured for use in certain applications. For example, the bonded abrasive body 201 can have a thickness the body comprises a thickness of at least 2 mm, such as at least 3 mm or at least 4 mm or at least 5 mm or at least 10 mm or at least 15 mm or at least 20 mm or at least 30 mm or at least 50 mm or at least 100 mm or at least 200 mm or at least 300 mm. Still, in another embodiment, the thickness (t) of the bonded abrasive body 201 can be not greater than 500 mm, such as not greater than 400 mm or at least 300 mm or not greater than 200 mm or not greater than 100 mm or not greater than 80 mm or not greater than 60 mm or not greater than 40 mm or not greater than 20 mm or not greater than 10 mm. It will be appreciated that the thickness (t) of the bonded abrasive body 201 can be within a range including any of the minimum and maximum values noted above, such as a volume of at least 2 mm to not greater than 400 mm. Reference herein to a thickness may be an average thickness of the bonded abrasive body, which is averaged from multiple measurements.

The bonded abrasive body 201 may have a particular aspect ratio (D:t) of at least 5:1, such as at least 10:1 or at least 20:1 or at least 40:1 or at least 50:1 or at least 100:1 or at least 150:1 or at least 300:1 or at least 500:1 or at least 800:1 or at least 1000:1. Still, in another non-limiting embodiment, the aspect ratio (D:t) may be not greater than 100,000:1 or not greater than 10,000:1 or not greater than 1000:1 or not greater than 500:1. It will be appreciated that the aspect ratio can be within a range, including any of the minimum to maximum ratios noted above.

The bonded abrasive body 201 may include abrasive particles having an average particle size (D50) of at least 40 microns. The bonded abrasive bodies herein may utilize relatively large size abrasive particles, which have historically proven difficult to homogeneously distribute throughout the mixture and resulting bonded abrasive body. Notably, due to their relatively larger sizes, such abrasive particles have a tendency to segregate and agglomerate in the gel and mixture, resulting in abrasive products with in-homogeneities and density variations. In one particular embodiment, the abrasive particles can have an average particle size (D50) of at least 50 microns or at least 55 microns or at least 60 microns or at least 65 microns or at least 70 microns or at least 75 microns or at least 80 microns or at least 85 microns or at least 90 microns or at least 95 microns or at least 100 microns or at least 105 microns or at least 110 microns or at least 115 microns or at least 120 microns or at least 130 microns or at least 150 microns or at least 175 microns or at least 200 microns or at least 250 microns or at least 300 microns or at least 350 microns or at least 400 microns or at least 450 microns or at least 500 microns or at least 600 microns or at least 700 microns or at least 800 microns. Still, in one non-limiting embodiment, the abrasive particles may have an average particle size (D50) of not greater than 5000 microns or not greater than 4000 microns or not greater than 3000 microns or not greater than 2000 microns or not greater than 1000 microns or not greater than 900 microns or not greater than 800 microns or not greater than 700 microns or not greater than 600 microns or not greater than 500 microns or not greater than 400 microns or not greater than 300 microns or not greater than 200 microns or not greater than 150 microns or not greater than 130 microns. The abrasive particles may have an average particle size (D50) within a range including any of the minimum and maximum values noted above, including, for example, but not limited to within a range of at least 50 microns to not greater than 5000 microns or within a range of at least 100 micros to not greater than 2000 microns or within a range of at least 50 microns to not greater than 800 microns or even within a range of at least 50 microns to not greater than 400 microns.

The abrasive particles may have various compositions, shapes, sizes, and other features. For example, the abrasive particles may include an abrasive particle type such as from the group of claimed unagglomerated particles, agglomerated particles, shaped abrasive particles, shaped abrasive composites, constant thickness abrasive particles (CTAP), randomly shaped abrasive particles, or any combination thereof. In another embodiment, the abrasive particles may include a material such as from the group of oxides, borides, nitrides, carbides, oxynitrides, oxycarbides, amorphous, monocrystalline, polycrystalline, superabrasive, or any combination thereof. In one particular embodiment, the first set of abrasive particles can include alumina, and may consist essentially of alumina.

In accordance with one embodiment, the bonded abrasive body 201 may have a particular structure that may facilitate improved performance. For example, the bonded abrasive body 201 may include a content of abrasive particles of at least 20 vol % for a total volume of the bonded abrasive body 201, such as at least 25 vol % or at least 30 vol % or at least 35 vol % or at least 40 vol % or at least 45 vol % or at least 50 vol % or at least 55 vol %. Still, in one non-limiting embodiment, the bonded abrasive body 201 may include a content of abrasive particles of not greater than 65 vol % for a total volume of the bonded abrasive body 201, such as not greater than 60 vol % or not greater than 55 vol % or not greater than 50 vol % or not greater than 45 vol % or not greater than 40 vol % or not greater than 35 vol % or not greater than 30 vol %. The content of abrasive particles in the bonded abrasive body 201 can be within a range, including any of the minimum and maximum percentages noted above.

Figure 4:
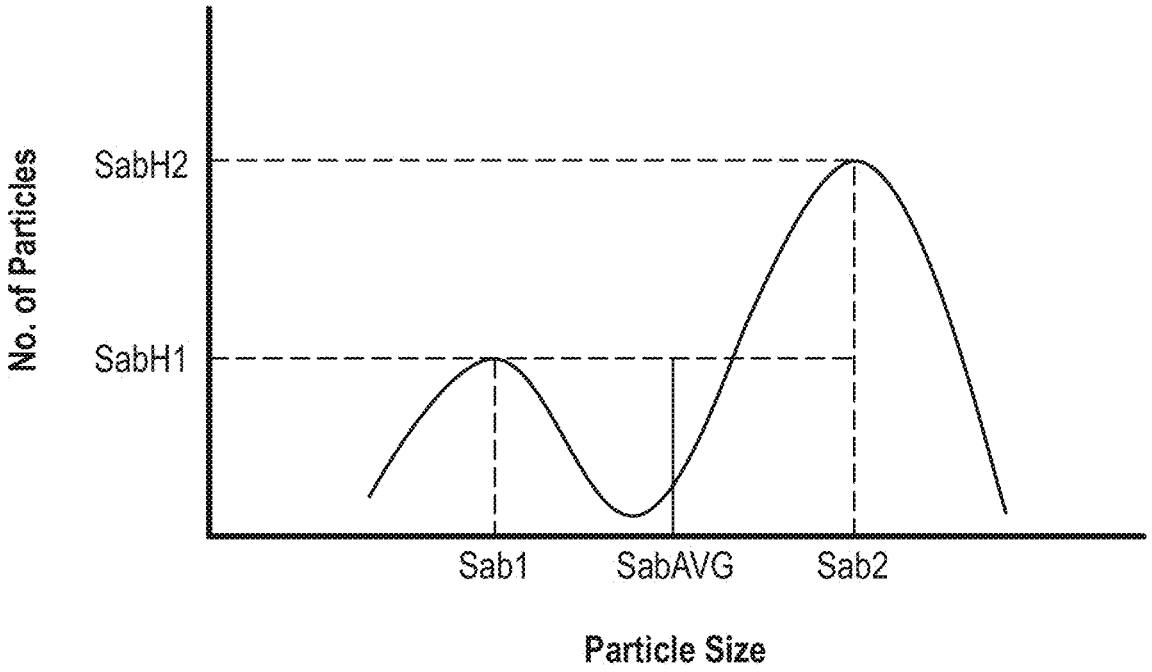
FIG. 4 includes an example of a multimodal particle size distribution.

In an embodiment, the abrasive particles in the body can have a multimodal particle size distribution. FIG. 4 includes a non-limiting example of a multimodal distribution. The particle size distribution can have a first mode, Sab1, corresponding to a first particle size and a second mode, Sab2, corresponding to a second particle size, where Sab1 is smaller than Sab2. The first mode can have a first height SabH1, and the second mode can have a second height SabH2. The distribution also includes a particle size SabAVG, equal to the average of Sab1 and Sab2 ((Sab1+Sab2)/2).

In an embodiment, the first mode Sab1 can be a particular particle size that may facilitate improved manufacturing and/or improved performance of the abrasive article. In an embodiment, Sab1 can be at least 5 microns or at least 10 microns or at least 15 microns or at least 20 microns or at least 25 microns or at least 30 microns or at least 35 microns or at least 40 microns or at least 45 microns or at least 50 microns or at least 55 microns or at least 60 microns. In another embodiment, Sab1 can be no greater than 150 microns or no greater than 140 microns or no greater than 130 microns or no greater than 120 microns or no greater than 110 microns or no greater than 100 microns or no greater than 95 microns or no greater than 90 microns or no greater than 85 microns or no greater than 80 microns or no greater than 75 microns or no greater than 70 microns or no greater than 65 microns or no greater than 60 microns or no greater than 55 microns. It will be appreciated that Sab1 can be between any of the minimum and maximum values noted above, including for example, but not limited to, at least 5 microns and no greater than 100 microns, at least 15 microns and no greater than 60 microns, or at least 25 microns and no greater than 120 microns.

In an embodiment, Sab2 can be a particular particle size that may facilitate improved manufacturing and/or improved performance of the abrasive article. In an embodiment, Sab2 can be at least 100 microns or at least 110 microns or at least 120 microns or at least 130 microns or at least 140 microns or at least 150 microns or at least 160 microns 170 microns or at least 180 microns or at least 190 microns or at least 200 microns or at least 210 microns or at least 220 microns or at least 230 microns or at least 240 microns or at least 250 microns or at least 260 microns or at least 270 microns or at least 280 microns or at least 290 microns or at least 300. In another embodiment, Sab2 can be no greater than 400 microns or no greater than 390 microns or no greater than 380 microns or no greater than 370 microns or no greater than 360 microns or no greater than 350 microns or no greater than 340 microns or no greater than 330 microns or no greater than 320 microns or no greater than 310 microns or no greater than 300 microns or no greater than 290 microns or no greater than 280 microns or no greater than 270 microns or no greater than 260 microns or no greater than 250 microns or no greater than 240 microns or no greater than 230 microns or no greater than 220 microns or no greater than 210 microns or no greater than 200 microns. It will be appreciated that Sab2 can be between any of the minimum and maximum values noted above, including for example, but not limited to, at least 100 microns and no greater than 400 microns, at least 200 microns and no greater than 360 microns, or at least 190 microns and no greater than 350 microns.

In an embodiment, the abrasive particle size distribution of the body can have a first mode Sab1, relative to Sab2 that may facilitate improved manufacturing and/or performance of the abrasive article. In an embodiment, Sab1 can be no greater than 80% of Sab2 or no greater than 75% or no greater than 70% or no greater than 65% or no greater than 60% or no greater than 55% or no greater than 50% or no greater than 45% or no greater than 40% or no greater than 35% or no greater than 30% or no greater than 25% or no greater than 20% of Sab2. In another embodiment Sab1 can be at least 1% of Sab2 least 2% or at least 3% or at least 4% or at least 5% or at least 6% or at least 8% or at least 10% or at least 12% or at least 14% or at least 16% or at least 18% or at least 20% or at least 25% or at least 30% or at least 35% or at least 40% of Sab2. It will be appreciated that the particle size of Sab1 relative to Sab2 may be between any of the minimum and maximum values noted above, including, for example but not limited to at least 1% and no greater than 70%, at least 5% and no greater than 20%, or at least 2% and no greater than 40%.

In an embodiment, the abrasive particle size distribution of the body can have a difference between Sab1 and Sab2 (Sab2–Sab1) that may facilitate improved manufacturing and/or performance of the abrasive article. In an embodiment, the difference between Sab1 and Sab2 can be at least 10 microns or at least 15 microns or at least 20 microns or at least 25 microns or at least 30 microns or at least 35 microns or at least 40 microns or at least 45 microns or at least 50 microns or at least 55 microns or at least 60 microns or at least 65 microns or at least 70 microns or at least 75 microns or at least 80 microns or at least 85 microns or at least 90 microns or at least 95 microns or at least 100 microns or at least 105 microns or at least 110 microns or at least 115 microns or at least 120 microns or at least 125 microns or at least 130 microns or at least 135 microns or at least 140 microns or at least 145 microns or at least 150 microns or at least 155 microns or at least 160 microns or at least 165 microns or at least 170 microns or at least 175 microns or at least 180 microns or at least 185 microns or at least 190 microns or at least 195 microns or at least 200 microns. In another embodiment, the difference between Sab1 and Sab2 can be no greater than 300 microns or no greater than 295 microns or no greater than 290 microns or no greater than 285 microns or no greater than 280 microns or no greater than 275 microns or no greater than 270 microns or no greater than 265 microns or no greater than 260 microns or no greater than 255 microns or no greater than 250 microns or no greater than 245 microns or no greater than 240 microns or no greater than 235 microns or no greater than 230 microns or no greater than 225 microns or no greater than 220 microns or no greater than 215 microns or no greater than 210 microns or no greater than 205 microns or no greater than 200 microns. It will be appreciated that the difference between Sab1 and Sab2 can be between any of the minimum and maximum values noted above, including, for example, but not limited to, at least 90 microns and no greater than 250 microns, at least 100 microns and no greater than 240 microns, or at least 90 microns and no greater than 230 microns.

In an embodiment, the particle size distribution of the body can have a SabAVG that may facilitate improved manufacturing and/or performance of the abrasive article. In an embodiment, SabAVG can be at least 90 microns, or at least 100 microns or at least 110 microns or at least 120 microns or at least 130 microns or at least 140 microns or at least 150 microns or at least 160 microns 170 microns or at least 180 microns or at least 190 microns or at least 200 microns or at least 210 microns or at least 220 microns or at least 230 microns or at least 240 microns or at least 250 microns. In another embodiment, SabAVG can be no greater than 250 microns or no greater than 240 microns or no greater than 230 microns or no greater than 220 microns or no greater than 210 microns or no greater than 200 microns or no greater than 190 microns or no greater than 180 microns or no greater than 170 microns or no greater than 160 microns or no greater than 150 microns or no greater than 140 microns or no greater than 130 microns or no greater than 120 microns or no greater than 110 microns or no greater than 100 microns. It will be appreciated that SabAVG may be between any of the minimum and maximum values noted above, including for example but not limited to at least 90 microns and no greater than 250 microns, at least 100 microns and no greater than 240 microns, or at least 150 microns and no greater than 240 microns.

In an embodiment, the particle size distribution of the body can have a ratio of SabH1/SabH2 that may facilitate improved manufacturing and/or performance of the abrasive article. In an embodiment, SabH1/SabH2 can be at least 0.75 or at least 0.8 or at least 0.85 or at least 0.9 or at least 0.95 or at least 1 or at least 1.05 or at least 1.1 or at least 1.15 or at least 1.2 or at least 1.25 or at least 1.3 or at least 1.35 or at least 1.4 or at least 1.45 or at least 1.5. In another embodiment, SabH1/SabH2 can be no greater than 10 or no greater than 9.5 or no greater than 9 or no greater than 8.5 or no greater than 8 or no greater than 7.5 or no greater than 7 or no greater than 6.5 or no greater than 6 or no greater than 5.5 or no greater than 5. It will be appreciated that SabH1/SabH2 may be between any of the minimum and maximum values noted above, including, for example, but not limited to at least 0.75 and no greater than 10, at least 1 and no greater than 8, or at least 0.9 and no greater than 6.

The abrasive particles of the first set of abrasive particles may have various compositions, shapes, sizes, and other features. For example, the abrasive particles may include an abrasive particle type such as from the group of claimed unagglomerated particles, agglomerated particles, shaped abrasive particles, shaped abrasive composites, constant thickness abrasive particles (CTAP), randomly shaped abrasive particles, or any combination thereof. In another embodiment, the abrasive particles may include a material such as from the group of oxides, borides, nitrides, carbides, oxynitrides, oxycarbides, amorphous, monocrystalline, polycrystalline, superabrasive, or any combination thereof. In one particular embodiment, the first set of abrasive particles can include alumina, and may consist essentially of alumina.

The abrasive particles of the second set of abrasive particles may have various compositions, shapes, sizes, and other features. For example, the abrasive particles may include an abrasive particle type such as from the group of claimed unagglomerated particles, agglomerated particles, shaped abrasive particles, shaped abrasive composites, constant thickness abrasive particles (CTAP), randomly shaped abrasive particles, or any combination thereof. In another embodiment, the abrasive particles may include a material such as from the group of oxides, borides, nitrides, carbides, oxynitrides, oxycarbides, amorphous, monocrystalline, polycrystalline, superabrasive, or any combination thereof. In one particular embodiment, the second set of abrasive particles can include alumina, and may consist essentially of alumina.

In an embodiment, the body can contain a first set of abrasive particles having a particle size of at least SabAVG and a wt % Wab1 relative to the total weight of abrasive particles and a second set of abrasive particles having a particle size of no greater than SabAVG microns and a wt % Wab2 relative to the total weight of abrasive particles. In an embodiment, the body can have a particular Wab1 that may facilitate improved manufacturing and/or performance of the abrasive article. In an embodiment, Wab1 can be at least 1% or at least 1.25% or at least 1.5% or at least 1.75% or at least 2% or at least 2.25% or at least 2.5% or at least 2.75% or at least 3% or at least 3.25% or at least 3.5% or at least 4% or at least 5% or at least 6% or at least 7% or at least 8% or at least 9%. In another embodiment, Wab1 can be no greater than 50% or no greater than 45% or no greater than 40% or no greater than 35% or no greater than 30% or no greater than 25% or no greater than 20% or no greater than 15%. It will be appreciated that Wab1 can be between any of the minimum and maximum values noted above, including for example, but not limited to, at least 1% and no greater than 50%, at least 1.25% and no greater than 40%, or at least 2.5% and no greater than 35%.

In an embodiment, the body can have a particular Wab2 that may facilitate improved manufacturing and/or performance of the abrasive article. In an embodiment Wab2 can at least 50% or at least 55% or at least 60% or at least 65% or at least 70% or at least 75% or at least 80% or at least 85% or at least 90% or at least 91% or at least 92 or at least 93% or at least 94% or at least 95% or at least 96% or at least 97% or at least 98% or at least 99%. In another embodiment, Wab2 can be no greater than 99.9% or no greater than 99.5% or no greater than 99% or no greater than 98% or no greater than 97% or no greater than 96% or no greater than 95% or no greater than 94% or no greater than 93% or no greater than 92% or no greater than 91% or no greater than 90%. It will be appreciated that Wab2 can be between any of the minimum and maximum values noted above, including for example, but not limited to, at least 50% and no greater than 99.9%, at least 80% and no greater than 95%, or at least 85% and no greater than 99.5%.

In an embodiment, the body can have a particular ratio of Wab1 to Wab2 that may facilitate improved manufacturing and/or performance of the abrasive article. In an embodiment, Wab1/Wab2 can be at least 0.020 or at least 0.021 or at least 0.022 or at least 0.023 or at least 0.024 or at least 0.025 or at least 0.026 or at least 0.027 or at least 0.028 or at least 0.029 or at least 0.03 or at least 0.04 or at least 0.05 or at least 0.060 or at least 0.07. In another embodiment, Wab1/Wab2 can be no greater than 2 or no greater than 1 or no greater than 0.9 or no greater than 0.8 or no greater than 0.7 or no greater than 0.6 or no greater than 0.5 or no greater than 0.4 or no greater than 0.3 or no greater than 0.2 or no greater than 0.1. It will be appreciated that Wab1/Wab2 can be between any of the minimum and maximum values noted above, including, for example, but not limited to, at least 0.020 and no greater than 0.1, at least 0.025 and no greater than 0.4, or at least 0.03 and no greater than 0.2.

In an embodiment, the body can contain a first set of abrasive particles having a particle size of at least SabAVG and a number of particles Nab1 and a second set of abrasive particles having a particle size of no greater than SabAVG microns and a number of particles Nab2. In an embodiment, Nab1/Nab2 can be at least 0.75 or at least 0.8 or at least 0.85 or at least 0.9 or at least 0.95 or at least 1 or at least 1.05 or at least 1.1 or at least 1.15 or at least 1.2 or at least 1.25 or at least 1.3 or at least 1.35 or at least 1.4 or at least 1.45 or at least 1.5. In another embodiment, Nab1/Nab2 can be no greater than 10 or no greater than 9.5 or no greater than 9 or no greater than 8.5 or no greater than 8 or no greater than 7.5 or no greater than 7 or no greater than 6.5 or no greater than 6 or no greater than 5.5 or no greater than 5. It will be appreciated that Nab1/Nab2 may be between any of the minimum and maximum values noted above, including, for example, but not limited to at least 0.75 and no greater than 10, at least 1 and no greater than 8, or at least 0.9 and no greater than 6.

In one particular aspect, the bonded abrasive body 201 can include a bond material, including an inorganic material. Some suitable examples of an inorganic material can include a metal, metal alloy, ceramic, vitreous phase, or any combination thereof. Furthermore, the bond material may include at least one of a vitreous phase, amorphous phase, a polycrystalline phase, a monocrystalline phase, or any combination thereof. In certain instances, the bond material can consist essentially of a polycrystalline phase, a vitreous phase, or a monocrystalline phase.

For at least one embodiment, the bond material may include an oxide, such as a vitreous oxide-containing material. Some suitable examples of oxides can include silicon dioxide, boron oxide, aluminum oxide, alkali oxide ($M_2O$), alkaline earth oxide (MO) transition metal oxide, rare earth metal oxide, or any combination thereof. In particular instances, the bond material may be a soda-lime vitreous material, borosilicate material, or aluminosilicate material.

The bonded abrasive body 201 may include a particular content of bond material that may facilitate improved performance. For example, the bonded abrasive body 201 may include a content of bond material of at least 1 vol % for a total volume of the bonded abrasive body 201, such as at least 2 vol % or at least 3 vol % or at least 4 vol % or at least 5 vol % or at least 6 vol % or at least 8 vol % or at least 10 vol % or at least 12 vol % or at least 14 vol % or at least 16 vol % or at least 18 vol % or at least 20 vol % or at least 25 vol % or at least 30 vol % or at least 35 vol % or at least 40 vol %. Still, in one non-limiting embodiment, the bonded abrasive body 201 can include a content of bond material of not greater than 65 vol % for a total volume of the bonded abrasive body 201 or not greater than 60 vol % or not greater than 55 vol % or not greater than 50 vol % or not greater than 45 vol % or not greater than 40 vol % or not greater than 35 vol % or not greater than 30 vol % or not greater than 25 vol % or not greater than 22 vol % or not greater than 20 vol % or not greater than 18 vol % or not greater than 16 vol % or not greater than 14 vol % or not greater than 12 vol % or not greater than 10 vol % or not greater than 8 vol % or not greater than 6 vol %. It will be appreciated that the content of bond material can be within a range including any of the minimum and maximum values noted above, including for example, a content of bond material within a range of at least 1 vol % and not greater than 15 vol % for a total volume of the body.

The bonded abrasive body 201 may include a particular structure such that it has a controlled content of the bond material relative to the content of abrasive particles. For example, in one instance, the body can have an ABR Factor (Cb/Cap) within a range of at least 0.5 to not greater than 10, wherein Cb represents the vol % of the bond material for the total volume of the bonded abrasive body 201 and Cap represents the vol % of the abrasive particles for the total volume of the bonded abrasive body 201. In particular instances, the bonded abrasive body 201 may have an ABR Factor (Cb/Cap) of at least 0.55, such as at least 0.6 or at least 0.65 or at least 0.7 or at least 0.75 or at least 0.8 or at least 0.85 or at least 0.9 or at least 0.95 or at least 1 or at least 1.05 or at least 1.1 or at least 1.15 or at least 1.2 or at least 1.25 or at least 1.3 or at least 1.35 or at least 1.4 or at least 1.45 or at least 1.5 or at least 1.55 or at least 1.6 or at least 1.65 or at least 1.7 or at least 1.75 or at least 1.8 or at least 1.85 or at least 1.9 or at least 1.95 or at least 2 or at least 2.2 or at least 2.5 or at least 2.8 or at least 3 or at least 3.5 or at least 4 or at least 4.5 or at least 5 or at least 5.5 or at least 6 or at least 7 or at least 8 or at least 9. Still, in another non-limiting embodiment, the bonded abrasive body 201 can have an ABR Factor (Cb/Cap) of not greater than 9, such as not greater than 8.5 or not greater than 8 or not greater than 7.5 or not greater than 7 or not greater than 6.5 or not greater than 6 or not greater than 5.5 or not greater than 5 or not greater than 4.5 or not greater than 4 or not greater than 3.5 or not greater than 3 or not greater than 2.5 or not greater than 2 or not greater than 1.5 or not greater than 1 or not greater than 0.9. It will be appreciated that the ABR Factor (Cb/Cap) can be within a range including any of the minimum and maximum values noted above.

In another embodiment, the bond abrasive body 201 may have a particular type and content of porosity that may facilitate improved performance of the abrasive article. For example, the bonded abrasive body 201 can have an average pore size (D50) of at least 10 microns, such as at least 20 microns or at least 30 microns or at least 40 microns or at least 50 microns or at least 60 microns or at least 70 microns or at least 80 microns or at least 90 microns or at least 100 microns or at least 200 microns or at least 300 microns or at least 400 microns or at least 500 microns or at least 600 microns or at least 700 microns or at least 800 microns or at least 900 microns. Still, in one non-limiting embodiment, the average pore size (D50) of the porosity of the bonded abrasive body 201 can be not greater than 1000 microns or not greater than 900 microns or not greater than 800 microns or not greater than 700 microns or not greater than 600 microns or not greater than 500 microns or not greater than 400 microns or not greater than 300 microns or not greater than 200 microns or not greater than 100 microns or not greater than 80 microns or not greater than 60 microns or not greater than 40 microns or not greater than 20 microns or not greater than 10 microns. It will be appreciated that the average pore size can be within a range, including any of the minimum and maximum values noted above.

The bonded abrasive body 201 may have a particular content of porosity that may facilitate improved performance. For example, the bonded abrasive body 201 may include at least 20 vol % porosity for a total volume of the bonded abrasive body 201, such as at least 25 vol % or at least 30 vol % or at least 35 vol % or at least 40 vol % or at least 45 vol % or at least 50 vol % or at least 55 vol % or at least 60 vol % or at least 65 vol % or at least 70 vol % or at least 75 vol % or at least 80 vol %. Still, in one non-limiting embodiment, the bonded abrasive body 201 can include not greater than 95 vol % porosity for a total volume of the bonded abrasive body 201, such as not greater than 90 vol % or not greater than 85 vol % or not greater than 80 vol % or not greater than 75 vol % or not greater than 70 vol % or not greater than 65 vol % or not greater than 60 vol % or not greater than 55 vol % or not greater than 50 vol % or not greater than 45 vol % or not greater than 40 vol % or not greater than 35 vol % or not greater than 30 vol %. It will be appreciated that the content of porosity in the bonded abrasive body 201 can be within a range, including any of the minimum and maximum percentages noted above.

The porosity of the bonded abrasive body 201 may include open porosity, closed porosity, or a combination thereof. Open porosity can be defined as interconnected channels extending through the bonded abrasive body 201. Closed porosity can define discrete and isolated voids contained in the bond material. In accordance with an embodiment, In accordance with an embodiment, the bonded abrasive body 201 may include a particular content of open porosity that may facilitate improved performance. For example, the bonded abrasive body 201 may include at least 10 vol % open porosity for a total volume of the porosity, such as at least 15 vol % or at least 20 vol % or at least 30 vol % or at least 40 vol % or at least 50 vol % or at least 60 vol % or at least 70 vol % or at least 80 vol % or at least 90 vol %. Still, in one non-limiting embodiment, the bonded abrasive body 201 can include not greater than 95 vol % open porosity for a total volume of the porosity in the bonded abrasive body 201, such as not greater than 90 vol % or not greater than 80 vol % or not greater than 70 vol % or not greater than 60 vol % or not greater than 50 vol % or not greater than 40 vol % or not greater than 30 vol % or not greater than 20 vol %. In at least one embodiment, all of the porosity in the bonded abrasive body 201 can be open porosity. It will be appreciated that the content of open porosity can be within a range, including any of the minimum and maximum percentages noted above.

In accordance with an embodiment, the bonded abrasive body 201 may include a particular content of closed porosity that may facilitate improved performance. For example, the bonded abrasive body 201 may include at least 10 vol % closed porosity for a total content of the porosity in the bonded abrasive body 201, such as at least 15 vol % or at least 20 vol % or at least 30 vol % or at least 40 vol % or at least 50 vol % or at least 60 vol % or at least 70 vol % or at least 80 vol % or at least 90 vol %. Still, in one non-limiting embodiment, the bonded abrasive body 201 can include not greater than 95 vol % closed porosity for a total volume of the porosity in the bonded abrasive body 201, such as not greater than 90 vol % or not greater than 80 vol % or not greater than 70 vol % or not greater than 60 vol % or not greater than 50 vol % or not greater than 40 vol % or not greater than 30 vol % or not greater than 20 vol %. In at least one embodiment, all of the porosity in the bonded abrasive body 201 can be closed porosity. It will be appreciated that the content of closed porosity can be within a range, including any of the minimum and maximum percentages noted above.

The processes of the embodiments herein may facilitate formation of bonded abrasive articles having particular grades and/or structures utilizing relatively large abrasive particles and having a superior homogeneity in terms of the distribution of phases throughout the body in a manner that was not previously achieved by conventional processing. Notably, the bonded abrasive body 201 may have a particular homogeneity factor of not greater than 85. For example, the Homogeneity Factor may be not greater than 84 or not greater than 82 or not greater than 80 or not greater than 78 or not greater than 76 or not greater than 74 or not greater than 72 or not greater than 70 or not greater than 68 or not greater than 66 or not greater than 64 or not greater than 62 or not greater than 60 or not greater than 58 or not greater than 56 or not greater than 54 or not greater than 52 or not greater than 50 or not greater than 48 or not greater than 46 or not greater than 44 or not greater than 42 or not greater than 40 or not greater than 38 or not greater than 36 or not greater than 34 or not greater than 32 or not greater than 30 or not greater than 28 or not greater than 26 or not greater than 24 or not greater than 22 or not greater than 20 or not greater than 18 or not greater than 16 or not greater than 14 or not greater than 12 or not greater than 10 or not greater than 8 or not greater than 6 or not greater than 4 or not greater than 2. Still, in one non-limiting embodiment, the Homogeneity Factor may be at least 1, such as at least 2 or at least 4 or at least 6 or at least 8 or at least 10 or at least 12 or at least 14 or at least 16 or at least 18 or at least 20 or at least 22 or at least 24 or at least 26 or at least 28 or at least 30 or at least 32 or at least 34 or at least 36 or at least 38 or at least 40 or at least 42 or at least 44 or at least 46 or at least 48 or at least 50 or at least 52 or at least 54 or at least 56 or at least 58 or at least 60 or at least 62 or at least 64 or at least 66 or at least 68 or at least 70 or at least 72 or at least 74 or at least 76 or at least 78 or at least 80. It will be appreciated that the Homogeneity Factor can be within a range including any of the minimum and maximum values noted above.

The Homogeneity Factor can be evaluated by measuring the time-of-flight information through the bonded abrasive body via ultrasound system Mistras UltraPAC (UPK-T36-HS). Specifically, the bonded abrasive body can be submerged in water to fill all open porosity with the water. A single, pulse-echo ultrasound sensor (Model #KS75-1) with a 1 mHz immersion sensor and an active diameter of 19.0 mm is placed 1 inch from the wheel. The sensor is attached to a DC step motor that moves the sensor over the entire surface of the wheel while maintaining the 1-inch distance. UTWin V3.62 software is used to control the movement of the step motor. The gain is set at 10cB, 400V pulser, LP filter of 2.0 mHz, a HP filter of 0.5 mHz, and a 100 mHz sampling rate. The data is acquired and processed by JET color map array format to create an RGB image via the UTWin software. The scan resolution is 1.0×1.0 mm and the scan speed is 150 mm/s in the X-direction and 50 mm/s in the Z-direction.

Using the color (red-green-blue or RGB) images from the ultrasound analysis, the images are analyzed with image processing software, such as Matlab. The RGB image is converted in Matlab to a LAB image using the "rgb2lab" function in Matlab, which creates a suitable image to identify only those areas associated with the wheel. The portions of the image having a value of 100 are associated with open space (i.e., not the wheel) and removed from the image.

Next, the RGB image is converted into an index image where each pixel is assigned a color value out of 256 possible colors (i.e., values from 0-255). This is completed using the "rgb2ind" function of Matlab. The darkest blue is associated with the lowest value or 0 and the brightest red is associated with the highest value or 255.

After the index image is created, it is compared to the LAB image to ensure that only those pixels associated with the wheel are evaluated. The comparison is completed using a logical indexing operation where pixels from the index image that are not associated with the wheel area are removed from further analysis. The result is an area-corrected index image.

Figure 8:
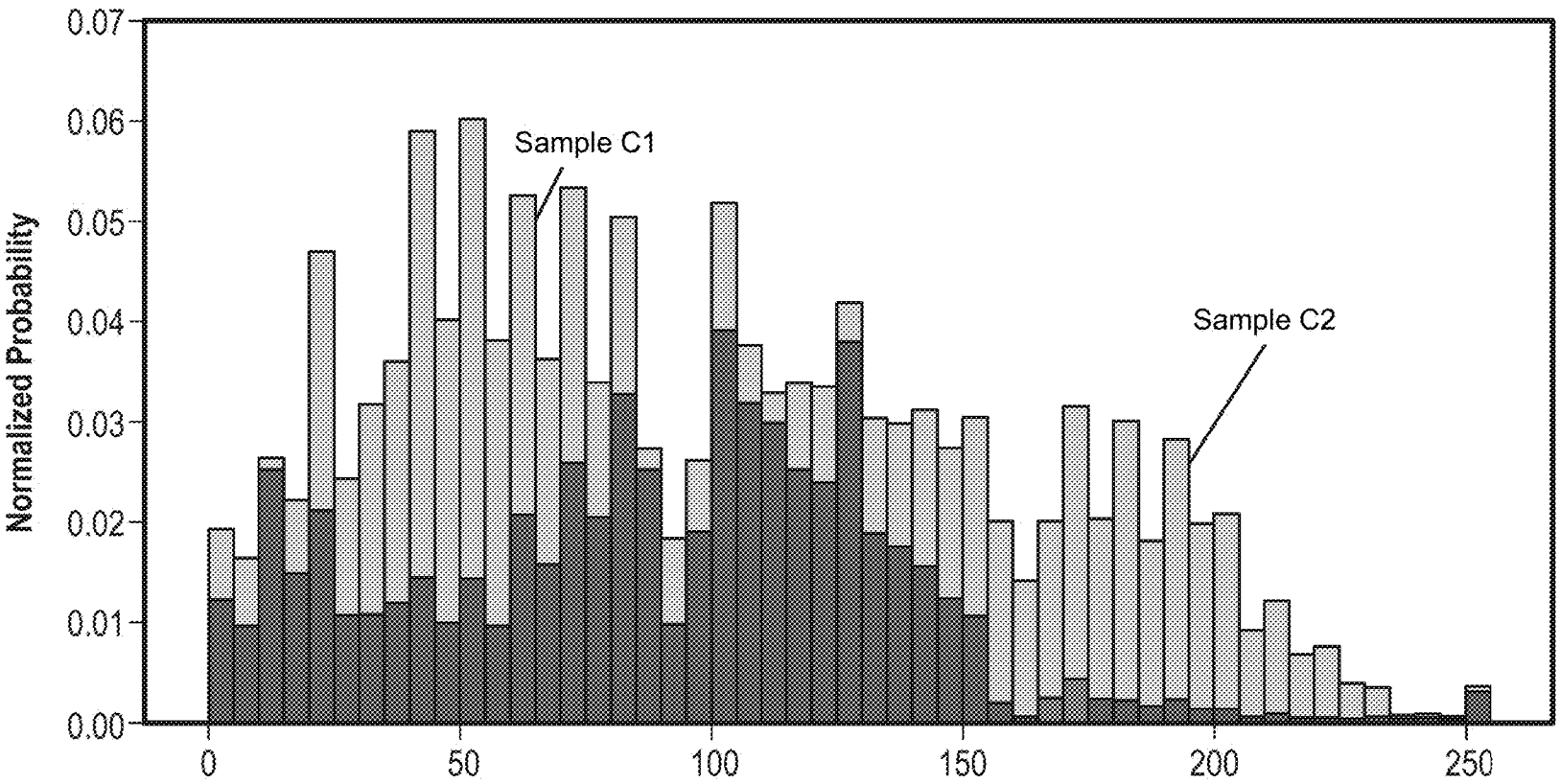
FIG. 8 includes a normalized probability plot for Samples C1 and C2 to evaluate the Homogeneity Factor.

The area-corrected index image is then used to create a normalized probability plot as illustrated in FIG. 8. Each box on the plot represents 5 sequential values between 0 and 255. For example, the first box (furthest left) represents the number of pixels having a value between 0 and 4. From the normalized probability plot and data used to generate the plot, statistical percentiles are evaluated. The percentiles include the $25^{th}$ percentile, $50^{th}$ percentile and $75^{th}$ percentile. The Homogeneity Factor is the difference between the $75^{th}$ percentile and the $25^{th}$ percentile. A body with a greater homogeneity of its components has less spread in the distribution between 0-255 and thus also has a lower difference between the $75^{th}$ percentile and the $25^{th}$ percentile.

The process of the embodiments herein may facilitate formation of bonded abrasive articles having particular grades and/or structures utilizing relatively large abrasive particles and having a consistent hardness throughout the body in a manner that it was not previously achieved by conventional processing. Notably, the bonded abrasive body can have a Hardness Variation Factor 1 (HVF1) of no greater than 0.50 mm no greater than 0.48 mm or no greater than 0.46 mm or no greater than 0.44 mm or no greater than 0.42 mm or no greater than 0.40 mm or no greater than 0.38 mm or no greater than 0.36 mm or no greater than 0.34 mm or no greater than 0.32 mm or no greater than 0.30 mm or no greater than 0.28 mm or no greater than 0.24 mm or no greater than 0.20 mm or no greater than 0.18 mm or no greater than 0.16 mm or no greater than 0.14 mm or no greater than 0.12 mm or no greater than 0.1 mm or no greater than 0.08 mm or no greater than 0.06 mm. In another embodiment, the bonded abrasive body can have a HVF1 of at least 0.001 mm or at least 0.005 mm or at least 0.01 mm or at least 0.02 mm or at least 0.03 mm or at least 0.04 mm or at least 0.05 mm. It will be appreciated that the HFV1 of the body may be between any of the minimum or maximum values noted above, including, for example, but not limited to, at least 0.001 mm and no greater than 0.50 mm or at least 0.03 mm and no greater than 0.3 mm.

In an embodiment, the bonded abrasive body can have a Hardness Variation Factor 2 (HVF2) of no greater than 0.34 mm or no greater than 0.33 mm or no greater than 0.32 mm or no greater than 0.31 mm or no greater than 0.30 mm or no greater than 0.29 mm or no greater than 0.28 mm or no greater than 0.27 mm or no greater than 0.26 mm or no greater than 0.25 mm or no greater than 0.24 mm or no greater than 0.23 mm or no greater than 0.22 mm or no greater than 0.21 mm or no greater than 0.2 mm. In another embodiment, the bonded abrasive body can have a HVF2 of at least 0.001 mm or at least 0.005 mm or at least 0.01 mm or at least 0.02 mm or at least 0.03 mm or at least 0.04 mm or at least 0.05 mm or at least 0.06 mm or at least 0.07 mm or at least 0.08 mm or at least 0.09 mm or at least 0.1 mm. It will be appreciated that the HFV2 of the body may be between any of the minimum or maximum values noted above, including for example, but not limited to, at least 0.01 and no greater than 0.34 or at least 0.02 and no greater than 0.23.

Figure 5:
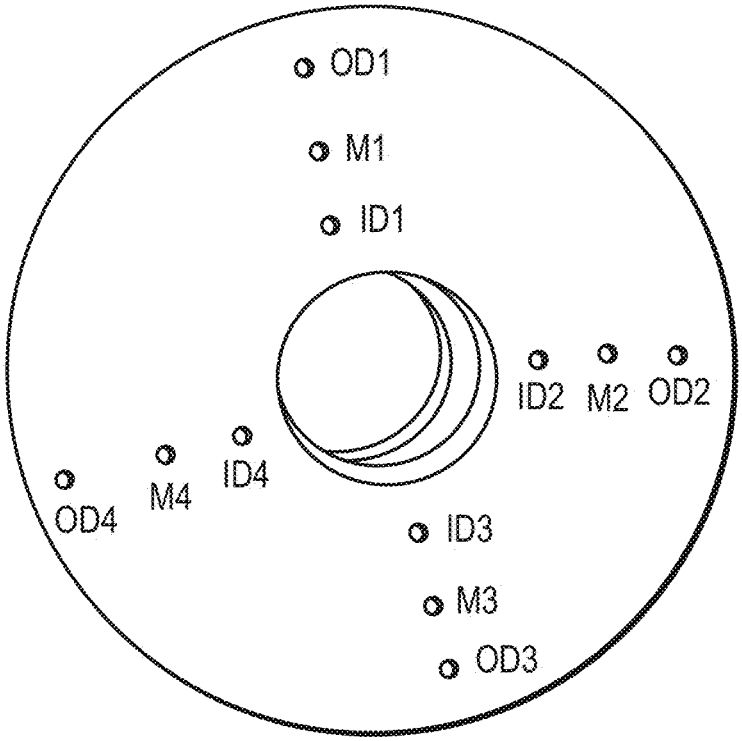
FIG. 5 includes an image of an abrasive article that has undergone sand blast penetration hardness testing.

Hardness measurements were taken according to the following procedure. The abrasive bodies were aligned with and contacted the outlet of a sandblasting device. Fine quartz was fired at abrasive bodies with a pressure of about 15 psi for 10 seconds forming a small crater in the abrasive body. The quartz used was AGSCO testing sand provided by AGSCO that conform to the ASTM C-778 Standard for Graded and 20/30 Sand. The depth of the craters in mm is measured using a depth gage. 24 total measurements were taken at different locations of the abrasive bodies. An image of a major surface of an abrasive article after hardness testing can be found in FIG. 5. 12 measurements were taken on each major surface, one at the inner diameter (ID), middle (M), and outer diameter (OD) of each quadrant of each major surface. For each sample, 2 hardness variation factors were calculated. The first hardness variation factor measures hardness variation between the first major surface and second major surface of the abrasive bodies and can be calculated via the following process:

1) Calculate the average of the hardness measurements taken on the first major surface.

2) Calculate the average of the hardness measurements taken on the second major surface.

3) Calculate the absolute value of the difference of the averages from steps 1 and 2.

The second hardness variation factor measures the hardness variation throughout the entire wheel and is equal to the standard deviation of all 24 hardness measurements taken. It will be appreciated that hardness variation factors can be calculated on different shapes of abrasive bodies. HVF 1 and 2 can be calculated by taking 12 well space measurements on opposing surfaces and performing the calculations noted above. For example, in FIG. 2B, hardness measurements can be taken on opposing major surfaces 205 and 206.

Many different aspects and embodiments are possible. Some of those aspects and embodiments are described herein. After reading this specification, skilled artisans will appreciate that those aspects and embodiments are only illustrative and do not limit the scope of the present invention. Embodiments may be in accordance with any one or more of the embodiments as listed below.

EMBODIMENTS

Embodiment 1. An abrasive article comprising:

a bonded abrasive having a body comprising:

a bond material comprising an inorganic material;

abrasive particles contained within the bond material;

the abrasive particles having particle size distribution defining a multimodal distribution having a first mode and a second mode, wherein the particle size of the first mode, Sab1 is smaller than the particle size of the second mode Sab2, wherein Sab1 is no greater than 80% of Sab2 and wherein the body comprises a homogeneity factor of not greater than 85.

Embodiment 2. An abrasive article comprising:

a bonded abrasive having a body comprising:

a bond material comprising an inorganic material;

abrasive particles contained within the bond material;

a Hardness Variation Factor 1 (HVF1) of no greater than 0.5 mm; and wherein the body comprises a homogeneity factor of not greater than 85.

Embodiment 3. An abrasive article comprising:

a bonded abrasive having a body comprising:

a bond material comprising an inorganic material;

abrasive particles contained within the bond material;

a Hardness Variation Factor 2 (HVF2) of no greater than 0.34 mm; and wherein the body comprises a homogeneity factor of 85.

Embodiment 4. The abrasive article of embodiments 1 and 2, wherein the abrasive article comprises an HVF2 of no greater than 0.34 mm.

Embodiment 5. The abrasive article of embodiments 1 and 3, wherein the abrasive article comprises an HVF1 of no greater than 0.5 mm.

Embodiment 6. The abrasive article of embodiments 2 and 3, wherein the abrasive particles having particle size distribution defining a multimodal distribution having a first mode and a second mode, wherein the particle size of the first mode, Sab1 is smaller than the particle size of the second mode Sab2 wherein Sab1 is no greater than 80% of Sab2.

Embodiment 7. The abrasive article of embodiments 1 and 6, wherein the difference between Sab1 and Sab2 is at least 10 microns or at least 15 microns or at least 20 microns or at least 25 microns or at least 30 microns or at least 35 microns or at least 40 microns or at least 45 microns or at least 50 microns or at least 55 microns or at least 60 microns or at least 65 microns or at least 70 microns or at least 75 microns or at least 80 microns or at least 85 microns or at least 90 microns or at least 95 microns or at least 100 microns or at least 105 microns or at least 110 microns or at least 115 microns or at least 120 microns or at least 125 microns or at least 130 microns or at least 135 microns or at least 140 microns or at least 145 microns or at least 150 microns or at least 155 microns or at least 160 microns or at least 165 microns or at least 170 microns or at least 175 microns or at least 180 microns or at least 185 microns or at least 190 microns or at least 195 microns or at least 200 microns.

Embodiment 8. The abrasive article of embodiments 1 and 6, wherein the difference between Sab1 and Sab2 is no greater than 300 microns or no greater than 295 microns or no greater than 290 microns or no greater than 285 microns or no greater than 280 microns or no greater than 275 microns or no greater than 270 microns or no greater than 265 microns or no greater than 260 microns or no greater than 255 microns or no greater than 250 microns or no greater than 245 microns or no greater than 240 microns or no greater than 235 microns or no greater than 230 microns or no greater than 225 microns or no greater than 220 microns or no greater than 215 microns or no greater than 210 microns or no greater than 205 microns or no greater than 200 microns.

Embodiment 9. The abrasive article of embodiments 1 and 6, wherein Sab1 is no greater than 75% of Sab2 or no greater than 70% or no greater than 65% or no greater than 60% or no greater than 55% or no greater than 50% or no greater than 45% or no greater than 40% or no greater than 35% or no greater than 30% or no greater than 25% or no greater than 20% of Sab2.

Embodiment 10. The abrasive article of embodiments 1 and 6, wherein Sab1 is at least 1% of Sab2 least 2% or at least 3% or at least 4% or at least 5% or at least 6% or at least 8% or at least 10% or at least 12% or at least 14% or at least 16% or at least 18% or at least 20% or at least 25% or at least 30% or at least 35% or at least 40% of Sab2.

Embodiment 11. The abrasive article of embodiments 1 and 6, wherein the particle size distribution includes SabAVG, an average of Sab1 and Sab2, wherein SabAVG is at least 90 microns, or at least 100 microns or at least 110 microns or at least 120 microns or at least 130 microns or at least 140 microns or at least 150 microns or at least 160 microns 170 microns or at least 180 microns or at least 190 microns or at least 200 microns or at least 210 microns or at least 220 microns or at least 230 microns or at least 240 microns or at least 250 microns.

Embodiment 12. The abrasive article of embodiments 1 and 6, wherein the particle size distribution includes SabAVG, an average of Sab1 and Sab2, wherein SabAVG is no greater than 250 microns or no greater than 240 microns or no greater than 230 microns or no greater than 220 microns or no greater than 210 microns or no greater than 200 microns or no greater than 190 microns or no greater than 180 microns or no greater than 170 microns or no greater than 160 microns or no greater than 150 microns or no greater than 140 microns or no greater than 130 microns or no greater than 120 microns or no greater than 110 microns or no greater than 100 microns.

Embodiment 13. The abrasive article of embodiments 1 and 6, wherein the particle size distribution includes SabAVG, an average of Sab1 and Sab2, and wherein abrasive particles comprise a first set of abrasive particles having a particle size of less than SabAVG and a wt % Wab1 relative to the total weight of abrasive particles, and a second set of abrasive particles having a particle size of equal to or greater than SabAVG and a wt % Wab2 relative to the total weight of the abrasive particles, and a wherein Wab1/Wab2 is at least 0.020 or at least 0.021 or at least 0.022 or at least 0.023 or at least 0.024 or at least 0.025 or at least 0.026 or at least 0.027 or at least 0.028 or at least 0.029 or at least 0.03 or at least 0.04 or at least 0.05 or at least 0.060 or at least 0.07.

Embodiment 14. The abrasive article of embodiments 1 and 6, wherein the particle size distribution includes SabAVG, an average of Sab1 and Sab2, wherein the abrasive particles comprise a first set of abrasive particles having a particle size of less than SabAVG and a wt % Wab1 relative to the total weight of abrasive particles, and a second set of abrasive particles having a particle size equal to or greater than SabAVG and a wt % Wab2 relative to the total weight of the abrasive particles, and a wherein Wab1/Wab2 is no greater than 2 or no greater than 1 or no greater than 0.9 or no greater than 0.8 or no greater than 0.7 or no greater than 0.6 or no greater than 0.5 or no greater than 0.4 or no greater than 0.3 or no greater than 0.2 or no greater than 0.1.

Embodiment 15. The abrasive article of embodiments 1 and 6, wherein the particle size distribution includes SabAVG, an average of Sab1 and Sab2, wherein the abrasive particles comprise a first set of abrasive particles having a particle size of less than SabAVG and a wt % Wab1 relative to the total weight of abrasive particles, wherein Wab1 is at least 1% or at least 1.25% or at least 1.5% or at least 1.75% or at least 2% or at least 2.25% or at least 2.5% or at least 2.75% or at least 3% or at least 3.25% or at least 3.5% or at least 4% or at least 5% or at least 6% or at least 7% or at least 8% or at least 9%.

Embodiment 16. The abrasive article of embodiments 1 and 6, wherein the particle size distribution includes SabAVG, an average of Sab1 and Sab2, wherein the abrasive particles comprise a first set of abrasive particles having a particle size of less than SabAVG and a wt % Wab1 relative to the total weight of abrasive particles, wherein Wab1 is no greater than 50% or no greater than 45% or no greater than 40% or no greater than 35% or no greater than 30% or no greater than 25% or no greater than 20% or no greater than 15%.

Embodiment 17. The abrasive article of embodiments 1 and 6, wherein the particle size distribution includes SabAVG, an average of Sab1 and Sab2, wherein the abrasive particles comprise a second set of abrasive particles having a particle size greater than or equal to SabAVG and a wt % Wab2 relative to the total weight of abrasive particles, wherein Wab2 is at least 50% or at least 55% or at least 60% or at least 65% or at least 70% or at least 75% or at least 80% or at least 85% or at least 90% or at least 91% or at least 92 or at least 93% or at least 94% or at least 95% or at least 96% or at least 97% or at least 98% or at least 99%.

Embodiment 18. The abrasive article of embodiments 1 and 6, wherein the particle size distribution includes SabAVG, an average of Sab1 and Sab2, wherein the abrasive particles comprise a second set of abrasive particles having a particle size of greater than or equal to SabAVG and a wt % Wab2 relative to the total weight of abrasive particles, wherein Wab2 is no greater than 99.9% or no greater than 99.5% or no greater than 99% or no greater than 98% or no greater than 97% or no greater than 96% or no greater than 95% or no greater than 94% or no greater than 93% or no greater than 92% or no greater than 91% or no greater than 90%.

Embodiment 19. The abrasive article of embodiments 1 and 6, wherein the abrasive particles comprise a first set of abrasive particles having a particle size of at SabAVG and a number of particles Nab1, and a second set of abrasive particles having a particle size of no greater SabAVG and a number of particles Nab2, wherein Nab1/Nab2 is at least 0.75 or at least 0.8 or at least 0.85 or at least 0.9 or at least 0.95 or at least 1 or at least 1.05 or at least 1.1 or at least 1.15 or at least 1.2 or at least 1.25 or at least 1.3 or at least 1.35 or at least 1.4 or at least 1.45 or at least 1.5.

Embodiment 20. The abrasive article of embodiments 1 and 6, wherein the abrasive particles comprise a first set of abrasive particles having a particle size of at SabAVG and a number of particles Nab1, and a second set of abrasive particles having a particle size of no greater SabAVG and a number of particles Nab2, wherein Nab1/Nab2 is no greater than 10 or no greater than 9.5 or no greater than 9 or no greater than 8.5 or no greater than 8 or no greater than 7.5 or no greater than 7 or no greater than 6.5 or no greater than 6 or no greater than 5.5 or no greater than 5.

Embodiment 21. The abrasive article of embodiments 1, 2, and 3, wherein the body comprises an HVF 1 of no greater than 0.48 mm or no greater than 0.46 mm or no greater than 0.44 mm or no greater than 0.42 mm or no greater than 0.40 mm or no greater than 0.38 mm or no greater than 0.36 mm or no greater than 0.34 mm or no greater than 0.32 mm or no greater than 0.30 mm or no greater than 0.28 mm or no greater than 0.24 mm or no greater than 0.20 mm or no greater than 0.18 mm or no greater than 0.16 mm or no greater than 0.14 mm or no greater than 0.12 mm or no greater than 0.1 mm or no greater than 0.08 mm or no greater than 0.06 mm.

Embodiment 22. The abrasive article of embodiments 1, 2, and 3, wherein the body comprises an HVF 1 of at least 0.001 mm or at least 0.005 mm or at least 0.01 mm or at least 0.02 mm or at least 0.03 mm or at least 0.04 mm or at least 0.05 mm.

Embodiment 23. The abrasive article of embodiments 1, 2, and 3, wherein the body comprises an HVF 2 of no greater than 0.34 mm or no greater than 0.33 mm or no greater than 0.32 mm or no greater than 0.31 mm or no greater than 0.30 mm or no greater than 0.29 mm or no greater than 0.28 mm or no greater than 0.27 mm or no greater than 0.26 mm or no greater than 0.25 mm or no greater than 0.24 mm or no greater than 0.23 mm or no greater than 0.22 mm or no greater than 0.21 mm or no greater than 0.2 mm.

Embodiment 24. The abrasive article of embodiments 1, 2, and 3, wherein the body comprises an HVF 2 of at least 0.001 mm or at least 0.005 mm or at least 0.01 mm or at least 0.02 mm or at least 0.03 mm or at least 0.04 mm or at least 0.05 mm or at least 0.06 mm or at least 0.07 mm or at least 0.08 mm or at least 0.09 mm or at least 0.1 mm.

Embodiment 25. The abrasive article of embodiments 1 and 6, wherein the first mode Sab1 is at least 5 microns or at least 10 microns or at least 15 microns or at least 20 microns or at least 25 microns or at least 30 microns or at least 35 microns or at least 40 microns or at least 45 microns or at least 50 microns or at least 55 microns or at least 60 microns.

Embodiment 26. The abrasive article of embodiments 1 and 6, wherein the first mode Sab1 is no greater than 150 microns or no greater than 140 microns or no greater than 130 microns or no greater than 120 microns or no greater than 110 microns or no greater than 100 microns or no greater than 95 microns or no greater than 90 microns or no greater than 85 microns or no greater than 80 microns or no greater than 75 microns or no greater than 70 microns or no greater than 65 microns or no greater than 60 microns or no greater than 55 microns.

Embodiment 27. The abrasive article of embodiments 1 and 6, wherein the second mode Sab2 is at least 100 microns or at least 110 microns or at least 120 microns or at least 130 microns or at least 140 microns or at least 150 microns or at least 160 microns 170 microns or at least 180 microns or at least 190 microns or at least 200 microns or at least 210 microns or at least 220 microns or at least 230 microns or at least 240 microns or at least 250 microns or at least 260 microns or at least 270 microns or at least 280 microns or at least 290 microns or at least 300.

Embodiment 28. The abrasive article of embodiments 1 and 6, wherein second mode Sab2 is no greater than 400 microns or no greater than 390 microns or no greater than 380 microns or no greater than 370 microns or no greater than 360 microns or no greater than 350 microns or no greater than 340 microns or no greater than 330 microns or no greater than 320 microns or no greater than 310 microns or no greater than 300 microns or no greater than 290 microns or no greater than 280 microns or no greater than 270 microns or no greater than 260 microns or no greater than 250 microns or no greater than 240 microns or no greater than 230 microns or no greater than 220 microns or no greater than 210 microns or no greater than 200 microns.

Embodiment 29. The abrasive article of embodiments 1 and 6, wherein the first mode has a first height SabH1, and the second mode has a second height SabH2 and SabH1/SabH2 is at least 0.75 or at least 0.8 or at least 0.85 or at least 0.9 or at least 0.95 or at least 1 or at least 1.05 or at least 1.1 or at least 1.15 or at least 1.2 or at least 1.25 or at least 1.3 or at least 1.35 or at least 1.4 or at least 1.45 or at least 1.5.

Embodiment 30. The abrasive article of embodiments 1 and 6, wherein the first mode has a first height SabH1, and the second mode has a second height SabH2 and SabH1/SabH2 is no greater than 10 or no greater than 9.5 or no greater than 9 or no greater than 8.5 or no greater than 8 or no greater than 7.5 or no greater than 7 or no greater than 6.5 or no greater than 6 or no greater than 5.5 or no greater than 5.

Embodiment 31. The abrasive article of embodiment 13, wherein the first set of abrasive particles comprises an abrasive particle type selected from the group consisting of unagglomerated particles, agglomerated particles, shaped abrasive particles, shaped abrasive composites, constant thickness abrasive particles (CTAP), randomly shaped abrasive particles, or any combination thereof.

Embodiment 32. The abrasive article of embodiment 13, wherein the second set of abrasive particles comprises an abrasive particle type selected from the group consisting of unagglomerated particles, agglomerated particles, shaped abrasive particles, shaped abrasive composites, constant thickness abrasive particles (CTAP), randomly shaped abrasive particles, or any combination thereof.

Embodiment 33. The abrasive article of embodiment 13, wherein the first set of abrasive particles comprises a material selected from the group consisting of oxides, borides, nitrides, carbides, oxynitrides, oxycarbides, amorphous, monocrystalline, polycrystalline, superabrasive, or any combination thereof.

Embodiment 34. The abrasive article of embodiment 13, wherein the first set of abrasive particles comprises alumina.

Embodiment 35. The abrasive article of embodiment 13, wherein the first set of abrasive particles consists of alumina.

Embodiment 36. The abrasive article of embodiment 13, wherein the second set of abrasive particles comprises a material selected from the group consisting of oxides, borides, nitrides, carbides, oxynitrides, oxycarbides, amorphous, monocrystalline, polycrystalline, superabrasive or any combination thereof.

Embodiment 37. The abrasive article of embodiment 13, wherein the second set of abrasive particles comprises alumina.

Embodiment 38. The abrasive article of embodiment 13, wherein the second set of abrasive particles consists of alumina.

Embodiment 39. The abrasive article of embodiments 1, 2, and 3, wherein the body comprises a content of abrasive particles of at least 20 vol % for a total volume of the body or at least 25 vol % or at least 30 vol % or at least 35 vol % or at least 40 vol % or at least 45 vol % or at least 50 vol % or at least 55 vol %

Embodiment 40. The abrasive article of embodiments 1, 2, and 3, wherein the body comprises a content of abrasive particles of not greater than 65 vol % for a total volume of the body or not greater than 60 vol % or not greater than 55 vol % or not greater than 50 vol % or not greater than 45 vol % or not greater than 40 vol % or not greater than 35 vol % or not greater than 30 vol %.

Embodiment 41. The abrasive article of embodiments 1, 2, and 3, wherein the body comprises a content of abrasive particles within a range of at least 20 vol % and not greater than 50 vol % for a total volume of the body.

Embodiment 42. The abrasive article of embodiments 1, 2, and 3, wherein the body comprises a content of bond material of at least 1 vol % for a total volume of the body or at least 2 vol % or at least 3 vol % or at least 4 vol % or at least 5 vol % or at least 6 vol % or at least 8 vol % or at least 10 vol % or at least 12 vol % or at least 14 vol % or at least 16 vol % or at least 18 vol % or at least 20 vol % or at least 25 vol % or at least 30 vol % or at least 35 vol % or at least 40 vol %.

Embodiment 43. The abrasive article of embodiments 1, 2, and 3, wherein the body comprises a content of bond material of not greater than 65 vol % for a total volume of the body or not greater than 60 vol % or not greater than 55 vol % or not greater than 50 vol % or not greater than 45 vol % or not greater than 40 vol % or not greater than 35 vol % or not greater than 30 vol % or not greater than 25 vol % or not greater than 22 vol % or not greater than 20 vol % or not greater than 18 vol % or not greater than 16 vol % or not greater than 14 vol % or not greater than 12 vol % or not greater than 10 vol % or not greater than 8 vol % or not greater than 6 vol %.

Embodiment 44. The abrasive article of embodiments 1, 2 and 3, wherein the body comprises a content of bond material within a range of at least 1 vol % and not greater than 15 vol % for a total volume of the body.

Embodiment 45. The abrasive article of embodiments 1, 2, and 3, wherein the bond material comprises an inorganic material selected from the group consisting of metal, metal alloy, ceramic, vitreous, or any combination thereof.

Embodiment 46. The abrasive article of embodiments 1, 2, and 3, wherein the bond material comprises a polycrystalline phase, an amorphous phase, a monocrystalline phase, or any combination thereof.

Embodiment 47. The abrasive article of embodiments 1, 2, and 3, wherein the bond material consists essentially of a polycrystalline phase, an amorphous phase, or a monocrystalline phase.

Embodiment 48. The abrasive article of embodiments 1, 2, and 3, wherein the bond material comprises an oxide.

Embodiment 49. The abrasive article of embodiments 1, 2, and 3, wherein the bond material comprises at least one composition selected from the group consisting of silicon dioxide ($SiO_2$), boron oxide ($B_2O_3$), aluminum oxide ($Al_2O_3$), alkali oxide ($M_2O$), alkaline earth oxide (MO) transition metal oxide, rare earth metal oxide, or any combination thereof.

Embodiment 50. The abrasive article of embodiments 1, 2, and 3, wherein the body comprises a Homogeneity Factor of at least 1 or at least 2 or at least 4 or at least 6 or at least 8 or at least 10 or at least 12 or at least 14 or at least 16 or at least 18 or at least 20 or at least 22 or at least 24 or at least 26 or at least 28 or at least 30 or at least 32 or at least 34 or at least 36 or at least 38 or at least 40 or at least 42 or at least 44 or at least 46 or at least 48 or at least 50 or at least 52 or at least 54 or at least 56 or at least 58 or at least 60 or at least 62 or at least 64 or at least 66 or at least 68 or at least 70 or at least 72 or at least 74 or at least 76 or at least 78 or at least 80.

Embodiment 51. The abrasive article of embodiments 1, 2 and 3, wherein the Homogeneity Factor is not greater than 85 or not greater than 84 or not greater than 82 or not greater than 80 or not greater than 78 or not greater than 76 or not greater than 74 or not greater than 72 or not greater than 70 or not greater than 68 or not greater than 66 or not greater than 64 or not greater than 62 or not greater than 60 or not greater than 58 or not greater than 56 or not greater than 54 or not greater than 52 or not greater than 50 or not greater than 48 or not greater than 46 or not greater than 44 or not greater than 42 or not greater than 40 or not greater than 38 or not greater than 36 or not greater than 34 or not greater than 32 or not greater than 30 or not greater than 28 or not greater than 26 or not greater than 24 or not greater than 22 or not greater than 20 or not greater than 18 or not greater than 16 or not greater than 14 or not greater than 12 or not greater than 10 or not greater than 8 or not greater than 6 or not greater than 4 or not greater than 2.

Embodiment 52. The abrasive article of embodiments 1, 2, and 3, wherein the body comprises a diameter of at least 260 mm or at least 270 mm or at least 280 mm or at least 290 mm or at least 300 mm or at least 325 mm or at least 350 mm or at least 375 mm or at least 400 mm or at least 425 mm or at least 450 mm or at least 475 mm or at least 500 mm or at least 525 mm or at least 550 mm or at least 575 mm.

Embodiment 53. The abrasive article of embodiments 1, 2, and 3, wherein the body comprises a diameter of not greater than 800 mm or not greater than 700 mm or not greater than 600 mm or not greater than 575 mm or not greater than 550 mm or not greater than 525 mm or not greater than 500 mm or not greater than 475 mm or not greater than 450 mm or not greater than 425 mm or not greater than 400 mm or not greater than 375 mm or not greater than 350 mm or not greater than 325 mm or not greater than 300 mm or not greater than 290 mm or not greater than 280 mm.

Embodiment 54. The abrasive article of embodiments 1, 2, and 3, wherein the diameter is within a range of at least 260 mm to not greater than 600 mm.

Embodiment 55. The abrasive article of embodiments 1, 2, and 3, wherein the body comprises a volume of at least 1 $cm^3$ or at least 10 $cm^3$ or at least 20 $cm^3$ or at least 30 $cm^3$ or at least 50 $cm^3$ or at least 75 $cm^3$ or at least 100 $cm^3$.

Embodiment 56. The abrasive article of embodiments 1, 2, and 3, wherein the body comprises a volume of not greater than 1000 $cm^3$ or not greater than 900 $cm^3$ or not greater than 800 $cm^3$ or not greater than 700 $cm^3$ or not greater than 600 $cm^3$ or not greater than 500 $cm^3$.

Embodiment 57. The abrasive article of embodiments 1, 2, and 3, wherein the body comprises a volume of at least 1 $cm^3$ to not greater than 1000 $cm^3$.

Embodiment 58. The abrasive article of embodiments 1, 2, and 3, wherein the body comprises a thickness of at least 2 mm or at least 3 mm or at least 4 mm or at least 5 mm or at least 10 mm or at least 15 mm or at least 20 mm or at least 30 mm or at least 50 mm or at least 100 mm or at least 200 mm or at least 300 mm.

Embodiment 59. The abrasive article of embodiments 1, 2, and 3, wherein the body comprises a thickness of not greater than 500 mm or not greater than 400 mm or at least 300 mm or not greater than 200 mm or not greater than 100 mm or not greater than 80 mm or not greater than 60 mm or not greater than 40 mm or not greater than 20 mm or not greater than 10 mm.

Embodiment 60. The abrasive article of embodiments 1, 2, and 3, wherein the body comprises a thickness within a range of at least 2 mm and not greater than 500 mm.

Embodiment 61. The abrasive article of embodiments 1, 2, and 3, wherein the body comprises a thickness within a range of at least 4 mm and not greater than 20 mm.

Embodiment 62. The abrasive article of embodiments 1, 2, and 3 wherein the porosity comprises an average pore size (D50) of at least 10 microns or least 20 microns or at least 30 microns or at least 40 microns or at least 50 microns or at least 60 microns or at least 70 microns or at least 80 microns or at least 90 microns or at least 100 microns or at least 200 microns or at least 300 microns or at least 400 microns or at least 500 microns or at least 600 microns or at least 700 microns or at least 800 microns or at least 900 microns.

Embodiment 63. The abrasive article of embodiments 1, 2, and 3 wherein the porosity comprises an average pore size (D50) of not greater than 1000 microns or not greater than 900 microns or not greater than 800 microns or not greater than 700 microns or not greater than 600 microns or not greater than 500 microns or not greater than 400 microns or not greater than 300 microns or not greater than 200 microns or not greater than 100 microns or not greater than 80 microns or not greater than 60 microns or not greater than 40 microns or not greater than 20 microns or not greater than 10 microns.

Embodiment 64. The abrasive article of embodiments 1, 2, and 3, wherein the porosity comprises an average pore size (D50) within a range of at least 10 microns and not greater than 1000 microns.

Embodiment 65. The abrasive article of embodiments 1, 2, and 3, wherein the body comprises a porosity of at least 20 vol % for a total volume of the body or at least 25 vol % or at least 30 vol % or at least 35 vol % or at least 40 vol % or at least 45 vol % or at least 50 vol % or at least 55 vol % or at least 60 vol % or at least 65 vol % or at least 70 vol % or at least 75 vol % or at least 80 vol %.

Embodiment 66. The abrasive article of embodiments 1, 2, and 3, wherein the body comprises a porosity of not greater than 95 vol % for a total volume of the body or not greater than 90 vol % or not greater than 85 vol % or not greater than 80 vol % or not greater than 75 vol % or not greater than 70 vol % or not greater than 65 vol % or not greater than 60 vol % or not greater than 55 vol % or not greater than 50 vol % or not greater than 45 vol % or not greater than 40 vol % or not greater than 35 vol % or not greater than 30 vol %.

Embodiment 67. The abrasive article of embodiments 1, 2, and 3, wherein the body comprises a porosity within a range of at least 20 vol % and not greater than 95 vol % for a total volume of the body.

Embodiment 68. The abrasive article of embodiments 1, 2, and 3, wherein at least a portion of the total porosity is open porosity, wherein the open porosity defines interconnected channels extending through the body.

Embodiment 69. The abrasive article of embodiment 68, wherein the body comprises at least 10 vol % open porosity for a total content of the porosity in the body or at least 15 vol % or at least 20 vol % or at least 30 vol % or at least 40 vol % or at least 50 vol % or at least 60 vol % or at least 70 vol % or at least 80 vol % or at least 90 vol % or wherein essentially all of the porosity is open porosity.

Embodiment 70. The abrasive article of embodiment 68, wherein the body comprises not greater than 95 vol % open porosity for a total content of the porosity in the body or not greater than 90 vol % or not greater than 80 vol % or not greater than 70 vol % or not greater than 60 vol % or not greater than 50 vol % or not greater than 40 vol % or not greater than 30 vol % or not greater than 20 vol %.

Embodiment 71. The abrasive article of embodiments 1, 2, and 3, wherein at least a portion of the total porosity is closed porosity, wherein the closed porosity defines discrete and isolated voids contained in the bond material.

Embodiment 72. The abrasive article of embodiment 71, wherein the body comprises at least 10 vol % closed porosity for a total content of the porosity in the body or at least 15 vol % or at least 20 vol % or at least 30 vol % or at least 40 vol % or at least 50 vol % or at least 60 vol % or at least 70 vol % or at least 80 vol % or at least 90 vol % or wherein essentially all of the porosity is closed porosity.

Embodiment 73. The abrasive article of embodiment 71, wherein the body comprises not greater than 95 vol % closed porosity for a total content of the porosity in the body or not greater than 90 vol % or not greater than 80 vol % or not greater than 70 vol % or not greater than 60 vol % or not greater than 50 vol % or not greater than 40 vol % or not greater than 30 vol % or not greater than 20 vol %.

Embodiment 74. A method of making an abrasive article comprising:

forming a mixture comprising abrasive particles, a bond precursor material and a gelling agent;

forming a bonded abrasive body from the mixture, wherein the bonded abrasive body comprises:

abrasive particles contained within the bond material;

wherein the abrasive particles have a particle size distribution defining a multimodal distribution having a first mode and a second mode, wherein the particle size of the first mode, Sab1 is smaller than the particle size of the second mode Sab2, wherein Sab1 is no greater than 80% of Sab2 and wherein the body comprises a homogeneity factor of not greater than 85.

Embodiment 75. A method of making an abrasive article comprising:

forming a mixture comprising abrasive particles, a bond precursor material and a gelling agent;

forming a bonded abrasive body from the mixture, wherein the bonded abrasive body comprises:

a bond material comprising an inorganic material;

abrasive particles contained within the bond material;

a Hardness Variation Factor 1 (HVF1) of no greater than 10; and wherein the body comprises a homogeneity factor of not greater than 85.

Embodiment 76. A method of making an abrasive article comprising:

forming a mixture comprising abrasive particles, a bond precursor material and a gelling agent;

forming a bonded abrasive body from the mixture, wherein the bonded abrasive body comprises:

a bond material comprising an inorganic material;

abrasive particles contained within the bond material;

a Hardness Variation Factor 2 (HVF2) of no greater than 14; and wherein the body comprises a homogeneity factor of 85.

Embodiment 77. The method of embodiments 74 and 75, wherein the abrasive article comprises an HVF2 of no greater than 0.34 mm.

Embodiment 78. The method of embodiments 74 and 76, wherein the abrasive article comprises an HVF1 of no greater than 0.5 mm.

Embodiment 79. The method of embodiments 75 and 76, wherein the abrasive particles having particle size distribution defining a multimodal distribution having a first mode and a second mode, wherein the particle size of the first mode, Sab1 is smaller than the particle size of the second mode Sab2 wherein Sab1 is no greater than 80% of Sab2.

Embodiment 80. The method of embodiments 74 and 79, wherein the difference between Sab1 and Sab2 is at least 10 microns or at least 15 microns or at least 20 microns or at least 25 microns or at least 30 microns or at least 35 microns or at least 40 microns or at least 45 microns or at least 50 microns or at least 55 microns or at least 60 microns or at least 65 microns or at least 70 microns or at least 75 microns or at least 80 microns or at least 85 microns or at least 90 microns or at least 95 microns or at least 100 microns or at least 105 microns or at least 110 microns or at least 115 microns or at least 120 microns or at least 125 microns or at least 130 microns or at least 135 microns or at least 140 microns or at least 145 microns or at least 150 microns or at least 155 microns or at least 160 microns or at least 165 microns or at least 170 microns or at least 175 microns or at least 180 microns or at least 185 microns or at least 190 microns or at least 195 microns or at least 200 microns.

Embodiment 81. The method of embodiments 74 and 79, wherein the difference between Sab1 and Sab2 is no greater than 300 microns or no greater than 295 microns or no greater than 290 microns or no greater than 285 microns or no greater than 280 microns or no greater than 275 microns or no greater than 270 microns or no greater than 265 microns or no greater than 260 microns or no greater than 255 microns or no greater than 250 microns or no greater than 245 microns or no greater than 240 microns or no greater than 235 microns or no greater than 230 microns or no greater than 225 microns or no greater than 220 microns or no greater than 215 microns or no greater than 210 microns or no greater than 205 microns or no greater than 200 microns.

Embodiment 82. The method of embodiments 74 and 79, wherein Sab1 is no greater than 75% of Sab2 or no greater than 70% or no greater than 65% or no greater than 60% or no greater than 55% or no greater than 50% or no greater than 45% or no greater than 40% or no greater than 35% or no greater than 30% or no greater than 25% or no greater than 20% of Sab2.

Embodiment 83. The method of embodiments 74 and 79, wherein Sab1 is at least 1% of Sab2 least 2% or at least 3% or at least 4% or at least 5% or at least 6% or at least 8% or at least 10% or at least 12% or at least 14% or at least 16% or at least 18% or at least 20% or at least 25% or at least 30% or at least 35% or at least 40% of Sab2.

Embodiment 84. The method of embodiments 74 and 79, wherein the particle size distribution includes SabAVG, an average of Sab1 and Sab2, wherein SabAVG is at least 90 microns, or at least 100 microns or at least 110 microns or at least 120 microns or at least 130 microns or at least 140 microns or at least 150 microns or at least 160 microns 170 microns or at least 180 microns or at least 190 microns or at least 200 microns or at least 210 microns or at least 220 microns or at least 230 microns or at least 240 microns or at least 250 microns.

Embodiment 85. The method of embodiments 74 and 79, wherein the particle size distribution includes SabAVG, an average of Sab1 and Sab2, wherein SabAVG is no greater than 250 microns or no greater than 240 microns or no greater than 230 microns or no greater than 220 microns or no greater than 210 microns or no greater than 200 microns or no greater than 190 microns or no greater than 180 microns or no greater than 170 microns or no greater than 160 microns or no greater than 150 microns or no greater than 140 microns or no greater than 130 microns or no greater than 120 microns or no greater than 110 microns or no greater than 100 microns.

Embodiment 86. The method of embodiments 74 and 79, wherein the particle size distribution includes SabAVG, an average of Sab1 and Sab2, and wherein abrasive particles comprise a first set of abrasive particles having a particle size of less than SabAVG and a wt % Wab1 relative to the total weight of abrasive particles, and a second set of abrasive particles having a particle size of equal to or greater than SabAVG and a wt % Wab2 relative to the total weight of the abrasive particles, and a wherein Wab1/Wab2 is at least 0.020 or at least 0.021 or at least 0.022 or at least 0.023 or at least 0.024 or at least 0.025 or at least 0.026 or at least 0.027 or at least 0.028 or at least 0.029 or at least 0.03 or at least 0.04 or at least 0.05 or at least 0.060 or at least 0.07.

Embodiment 87. The method of embodiments 74 and 79, wherein the particle size distribution includes SabAVG, an average of Sab1 and Sab2, wherein the abrasive particles comprise a first set of abrasive particles having a particle size of less than SabAVG and a wt % Wab1 relative to the total weight of abrasive particles, and a second set of abrasive particles having a particle size equal to or greater than SabAVG and a wt % Wab2 relative to the total weight of the abrasive particles, and a wherein Wab1/Wab2 is no greater than 2 or no greater than 1 or no greater than 0.9 or no greater than 0.8 or no greater than 0.7 or no greater than 0.6 or no greater than 0.5 or no greater than 0.4 or no greater than 0.3 or no greater than 0.2 or no greater than 0.1.

Embodiment 88. The method of embodiments 74 and 79, wherein the particle size distribution includes SabAVG, an average of Sab1 and Sab2, wherein the abrasive particles comprise a first set of abrasive particles having a particle size of less than SabAVG and a wt % Wab1 relative to the total weight of abrasive particles, wherein Wab1 is at least 1% or at least 1.25% or at least 1.5% or at least 1.75% or at least 2% or at least 2.25% or at least 2.5% or at least 2.75% or at least 3% or at least 3.25% or at least 3.5% or at least 4% or at least 5% or at least 6% or at least 7% or at least 8% or at least 9%.

Embodiment 89. The method of embodiments 74 and 79, wherein the particle size distribution includes SabAVG, an average of Sab1 and Sab2, wherein the abrasive particles comprise a first set of abrasive particles having a particle size of less than SabAVG and a wt % Wab1 relative to the total weight of abrasive particles, wherein Wab1 is no greater than 50% or no greater than 45% or no greater than 40% or no greater than 35% or no greater than 30% or no greater than 25% or no greater than 20% or no greater than 15%.

Embodiment 90. The method of embodiments 74 and 79, wherein the particle size distribution includes SabAVG, an average of Sab1 and Sab2, wherein the abrasive particles comprise a second set of abrasive particles having a particle size greater than or equal to SabAVG and a wt % Wab2 relative to the total weight of abrasive particles, wherein Wab2 is at least 50% or at least 55% or at least 60% or at least 65% or at least 70% or at least 75% or at least 80% or at least 85% or at least 90% or at least 91% or at least 92 or at least 93% or at least 94% or at least 95% or at least 96% or at least 97% or at least 98% or at least 99%.

Embodiment 91. The method of embodiments 74 and 79, wherein the particle size distribution includes SabAVG, an average of Sab1 and Sab2, wherein the abrasive particles comprise a second set of abrasive particles having a particle size of greater than or equal to SabAVG and a wt % Wab2 relative to the total weight of abrasive particles, wherein Wab2 is no greater than 99.9% or no greater than 99.5% or no greater than 99% or no greater than 98% or no greater than 97% or no greater than 96% or no greater than 95% or no greater than 94% or no greater than 93% or no greater than 92% or no greater than 91% or no greater than 90%.

Embodiment 92. The method of embodiments 74 and 79, wherein the abrasive particles comprise a first set of abrasive particles having a particle size of at SabAVG and a number of particles Nab1, and a second set of abrasive particles having a particle size of no greater SabAVG and a number of particles Nab2, wherein Nab1/Nab2 is at least 0.75 or at least 0.8 or at least 0.85 or at least 0.9 or at least 0.95 or at least 1 or at least 1.05 or at least 1.1 or at least 1.15 or at least 1.2 or at least 1.25 or at least 1.3 or at least 1.35 or at least 1.4 or at least 1.45 or at least 1.5.

Embodiment 93. The method of embodiments 74 and 79, wherein the abrasive particles comprise a first set of abrasive particles having a particle size of at SabAVG and a number of particles Nab1, and a second set of abrasive particles having a particle size of no greater SabAVG and a number of particles Nab2, wherein Nab1/Nab2 is no greater than 10 or no greater than 9.5 or no greater than 9 or no greater than 8.5 or no greater than 8 or no greater than 7.5 or no greater than 7 or no greater than 6.5 or no greater than 6 or no greater than 5.5 or no greater than 5.

Embodiment 94. The method of embodiments 74, 75 and 76, wherein the body comprises an HVF 1 of no greater than 0.48 mm or no greater than 0.46 mm or no greater than 0.44 mm or no greater than 0.42 mm or no greater than 0.40 mm or no greater than 0.38 mm or no greater than 0.36 mm or no greater than 0.34 mm or no greater than 0.32 mm or no greater than 0.30 mm or no greater than 0.28 mm or no greater than 0.24 mm or no greater than 0.20 mm or no greater than 0.18 mm or no greater than 0.16 mm or no greater than 0.14 mm or no greater than 0.12 mm or no greater than 0.1 mm or no greater than 0.08 mm or no greater than 0.06 mm.

Embodiment 95. The method of embodiments 74, 75 and 76, wherein the body comprises an HVF 1 of at least 0.001 mm or at least 0.005 mm or at least 0.01 mm or at least 0.02 mm or at least 0.03 mm or at least 0.04 mm or at least 0.05 mm.

Embodiment 96. The method of embodiments 74, 75 and 76, wherein the body comprises an HVF 2 of no greater than 0.34 mm or no greater than 0.33 mm or no greater than 0.32 mm or no greater than 0.31 mm or no greater than 0.30 mm or no greater than 0.29 mm or no greater than 0.28 mm or no greater than 0.27 mm or no greater than 0.26 mm or no greater than 0.25 mm or no greater than 0.24 mm or no greater than 0.23 mm or no greater than 0.22 mm or no greater than 0.21 mm or no greater than 0.2 mm.

Embodiment 97. The method of embodiments 74, 75, and 76, wherein the body comprises an HVF 2 of at least 0.001 mm or at least 0.005 mm or at least 0.01 mm or at least 0.02 mm or at least 0.03 mm or at least 0.04 mm or at least 0.05 mm or at least 0.06 mm or at least 0.07 mm or at least 0.08 mm or at least 0.09 mm or at least 0.1 mm.

Embodiment 98. The method of embodiments 74 and 79, wherein the first mode Sab1 is at least 5 microns or at least 10 microns or at least 15 microns or at least 20 microns or at least 25 microns or at least 30 microns or at least 35 microns or at least 40 microns or at least 45 microns or at least 50 microns or at least 55 microns or at least 60 microns.

Embodiment 99. The method of embodiments 74 and 79, wherein the first mode Sab1 is no greater than 150 microns or no greater than 140 microns or no greater than 130 microns or no greater than 120 microns or no greater than 110 microns or no greater than 100 microns or no greater than 95 microns or no greater than 90 microns or no greater than 85 microns or no greater than 80 microns or no greater than 75 microns or no greater than 70 microns or no greater than 65 microns or no greater than 60 microns or no greater than 55 microns.

Embodiment 100. The method of embodiments 74 and 79, wherein the second mode Sab2 is at least 100 microns or at least 110 microns or at least 120 microns or at least 130 microns or at least 140 microns or at least 150 microns or at least 160 microns 170 microns or at least 180 microns or at least 190 microns or at least 200 microns or at least 210 microns or at least 220 microns or at least 230 microns or at least 240 microns or at least 250 microns or at least 260 microns or at least 270 microns or at least 280 microns or at least 290 microns or at least 300.

Embodiment 101. The method of embodiments 74 and 79, wherein second mode Sab2 is no greater than 400 microns or no greater than 390 microns or no greater than 380 microns or no greater than 370 microns or no greater than 360 microns or no greater than 350 microns or no greater than 340 microns or no greater than 330 microns or no greater than 320 microns or no greater than 310 microns or no greater than 300 microns or no greater than 290 microns or no greater than 280 microns or no greater than 270 microns or no greater than 260 microns or no greater than 250 microns or no greater than 240 microns or no greater than 230 microns or no greater than 220 microns or no greater than 210 microns or no greater than 200 microns.

Embodiment 102. The method of embodiments 74 and 79, wherein the first mode has a first height SabH1, and the second mode has a second height SabH2 and SabH1/SabH2 is at least 0.75 or at least 0.8 or at least 0.85 or at least 0.9 or at least 0.95 or at least 1 or at least 1.05 or at least 1.1 or at least 1.15 or at least 1.2 or at least 1.25 or at least 1.3 or at least 1.35 or at least 1.4 or at least 1.45 or at least 1.5.

Embodiment 103. The method of embodiments 74 and 79, wherein the first mode has a first height SabH1, and the second mode has a second height SabH2 and SabH1/SabH2 is no greater than 10 or no greater than 9.5 or no greater than 9 or no greater than 8.5 or no greater than 8 or no greater than 7.5 or no greater than 7 or no greater than 6.5 or no greater than 6 or no greater than 5.5 or no greater than 5.

Embodiment 104. The method of embodiment 87, wherein the first set of abrasive particles comprises an abrasive particle type selected from the group consisting of unagglomerated particles, agglomerated particles, shaped abrasive particles, shaped abrasive composites, constant thickness abrasive particles (CTAP), randomly shaped abrasive particles, or any combination thereof.

Embodiment 105. The method of embodiment 87, wherein the second set of abrasive particles comprises an abrasive particle type selected from the group consisting of unagglomerated particles, agglomerated particles, shaped abrasive particles, shaped abrasive composites, constant thickness abrasive particles (CTAP), randomly shaped abrasive particles, or any combination thereof.

Embodiment 106. The method of embodiment 87, wherein the first set of abrasive particles comprises a material selected from the group consisting of oxides, borides, nitrides, carbides, oxynitrides, oxycarbides, amorphous, monocrystalline, polycrystalline, superabrasive or any combination thereof.

Embodiment 107. The method of embodiment 87, wherein the first set of abrasive particles comprises alumina.

Embodiment 108. The method of embodiment 87, wherein the first set of abrasive particles consists of alumina.

Embodiment 109. The method of embodiment 87, wherein the second set of abrasive particles comprises a material selected from the group consisting of oxides, borides, nitrides, carbides, oxynitrides, oxycarbides, amorphous, monocrystalline, polycrystalline, superabrasive or any combination thereof.

Embodiment 110. The method of embodiment 87, wherein the second set of abrasive particles comprises alumina.

Embodiment 111. The method of embodiment 87, wherein the second set of abrasive particles consists of alumina.

Embodiment 112. The method of embodiments 74, 75, and 76, wherein the body comprises a content of abrasive particles of at least 20 vol % for a total volume of the body or at least 25 vol % or at least 30 vol % or at least 35 vol % or at least 40 vol % or at least 45 vol % or at least 50 vol % or at least 55 vol %

Embodiment 113. The method of embodiments 74, 75, and 76, wherein the body comprises a content of abrasive particles of not greater than 65 vol % for a total volume of the body or not greater than 60 vol % or not greater than 55 vol % or not greater than 50 vol % or not greater than 45 vol % or not greater than 40 vol % or not greater than 35 vol % or not greater than 30 vol %.

Embodiment 114. The method of embodiments 74, 75, and 76, wherein the body comprises a content of abrasive particles within a range of at least 20 vol % and not greater than 50 vol % for a total volume of the body.

Embodiment 115. The method of embodiments 74, 75, and 76, wherein the body comprises a content of bond material of at least 1 vol % for a total volume of the body or at least 2 vol % or at least 3 vol % or at least 4 vol % or at least 5 vol % or at least 6 vol % or at least 8 vol % or at least 10 vol % or at least 12 vol % or at least 14 vol % or at least 16 vol % or at least 18 vol % or at least 20 vol % or at least 25 vol % or at least 30 vol % or at least 35 vol % or at least 40 vol %.

Embodiment 116. The method of embodiments 74, 75, and 76, wherein the body comprises a content of bond material of not greater than 65 vol % for a total volume of the body or not greater than 60 vol % or not greater than 55 vol % or not greater than 50 vol % or not greater than 45 vol % or not greater than 40 vol % or not greater than 35 vol % or not greater than 30 vol % or not greater than 25 vol % or not greater than 22 vol % or not greater than 20 vol % or not greater than 18 vol % or not greater than 16 vol % or not greater than 14 vol % or not greater than 12 vol % or not greater than 10 vol % or not greater than 8 vol % or not greater than 6 vol %.

Embodiment 117. The method of embodiments 74, 75, and 76, wherein the body comprises a content of bond material within a range of at least 1 vol % and not greater than 15 vol % for a total volume of the body.

Embodiment 118. The method of embodiments 74, 75, and 76, wherein the bond material comprises an inorganic material selected from the group consisting of metal, metal alloy, ceramic, vitreous, or any combination thereof.

Embodiment 119. The method of embodiments 74, 75, and 76, wherein the bond material comprises a polycrystalline phase, an amorphous phase, a monocrystalline phase, or any combination thereof.

Embodiment 120. The method of embodiments 74, 75, and 76, wherein the bond material consists essentially of a polycrystalline phase, an amorphous phase, or a monocrystalline phase.

Embodiment 121. The method of embodiments 74, 75, and 76, wherein the bond material comprises an oxide.

Embodiment 122. The method of embodiments 74, 75, and 76, wherein the bond material comprises at least one composition selected from the group consisting of silicon dioxide ($SiO_2$), boron oxide ($B_2O_3$), aluminum oxide ($Al_2O_3$), alkali oxide ($M_2O$), alkaline earth oxide (MO) transition metal oxide, rare earth metal oxide, or any combination thereof.

Embodiment 123. The method of embodiments 74, 75, and 76, wherein the body comprises a Homogeneity Factor of at least 1 or at least 2 or at least 4 or at least 6 or at least 8 or at least 10 or at least 12 or at least 14 or at least 16 or at least 18 or at least 20 or at least 22 or at least 24 or at least 26 or at least 28 or at least 30 or at least 32 or at least 34 or at least 36 or at least 38 or at least 40 or at least 42 or at least 44 or at least 46 or at least 48 or at least 50 or at least 52 or at least 54 or at least 56 or at least 58 or at least 60 or at least 62 or at least 64 or at least 66 or at least 68 or at least 70 or at least 72 or at least 74 or at least 76 or at least 78 or at least 80.

Embodiment 124. The method of embodiments 74, 75 and 76, wherein the Homogeneity Factor is not greater than 85 or not greater than 84 or not greater than 82 or not greater than 80 or not greater than 78 or not greater than 76 or not greater than 74 or not greater than 72 or not greater than 70 or not greater than 68 or not greater than 66 or not greater than 64 or not greater than 62 or not greater than 60 or not greater than 58 or not greater than 56 or not greater than 54 or not greater than 52 or not greater than 50 or not greater than 48 or not greater than 46 or not greater than 44 or not greater than 42 or not greater than 40 or not greater than 38 or not greater than 36 or not greater than 34 or not greater than 32 or not greater than 30 or not greater than 28 or not greater than 26 or not greater than 24 or not greater than 22 or not greater than 20 or not greater than 18 or not greater than 16 or not greater than 14 or not greater than 12 or not greater than 10 or not greater than 8 or not greater than 6 or not greater than 4 or not greater than 2.

Embodiment 125. The method of embodiments 74, 75, and 76, wherein the body comprises a diameter of at least 260 mm or at least 270 mm or at least 280 mm or at least 290 mm or at least 300 mm or at least 325 mm or at least 350 mm or at least 375 mm or at least 400 mm or at least 425 mm or at least 450 mm or at least 475 mm or at least 500 mm or at least 525 mm or at least 550 mm or at least 575 mm.

Embodiment 126. The method of embodiments 74, 75, and 76, wherein the body comprises a diameter of not greater than 800 mm or not greater than 700 mm or not greater than 600 mm or not greater than 575 mm or not greater than 550 mm or not greater than 525 mm or not greater than 500 mm or not greater than 475 mm or not greater than 450 mm or not greater than 425 mm or not greater than 400 mm or not greater than 375 mm or not greater than 350 mm or not greater than 325 mm or not greater than 300 mm or not greater than 290 mm or not greater than 280 mm.

Embodiment 127. The method of embodiments 74, 75, and 76, wherein the diameter is within a range of at least 260 mm to not greater than 600 mm.

Embodiment 128. The method of embodiments 74, 75, and 76, wherein the body comprises a volume of at least 1 $cm^3$ or at least 10 $cm^3$ or at least 20 $cm^3$ or at least 30 $cm^3$ or at least 50 $cm^3$ or at least 75 $cm^3$ or at least 100 $cm^3$.

Embodiment 129. The method of embodiments 74, 75, and 76, wherein the body comprises a volume of not greater than 1000 $cm^3$ or not greater than 900 $cm^3$ or not greater than 800 $cm^3$ or not greater than 700 $cm^3$ or not greater than 600 $cm^3$ or not greater than 500 $cm^3$.

Embodiment 130. The method of embodiments 74, 75, and 76, wherein the body comprises a volume of at least 1 $cm^3$ to not greater than 1000 $cm^3$.

Embodiment 131. The method of embodiments 74, 75, and 76, wherein the body comprises a thickness of at least 2 mm or at least 3 mm or at least 4 mm or at least 5 mm or at least 10 mm or at least 15 mm or at least 20 mm or at least 30 mm or at least 50 mm or at least 100 mm or at least 200 mm or at least 300 mm.

Embodiment 132. The method of embodiments 74, 75, and 76, wherein the body comprises a thickness of not greater than 500 mm or not greater than 400 mm or at least 300 mm or not greater than 200 mm or not greater than 100 mm or not greater than 80 mm or not greater than 60 mm or not greater than 40 mm or not greater than 20 mm or not greater than 10 mm.

Embodiment 133. The method of embodiments 74, 75, and 76, wherein the body comprises a thickness within a range of at least 2 mm and not greater than 500 mm.

Embodiment 134. The method of embodiments 74, 75, and 76, wherein the body comprises a thickness within a range of at least 4 mm and not greater than 20 mm.

Embodiment 135. The method of embodiments 74, 75, and 76, wherein the porosity comprises an average pore size (D50) of at least 10 microns or least 20 microns or at least 30 microns or at least 40 microns or at least 50 microns or at least 60 microns or at least 70 microns or at least 80 microns or at least 90 microns or at least 100 microns or at least 200 microns or at least 300 microns or at least 400 microns or at least 500 microns or at least 600 microns or at least 700 microns or at least 800 microns or at least 900 microns.

Embodiment 136. The method of embodiments 74, 75, and 76, wherein the porosity comprises an average pore size (D50) of not greater than 1000 microns or not greater than 900 microns or not greater than 800 microns or not greater than 700 microns or not greater than 600 microns or not greater than 500 microns or not greater than 400 microns or not greater than 300 microns or not greater than 200 microns or not greater than 100 microns or not greater than 80 microns or not greater than 60 microns or not greater than 40 microns or not greater than 20 microns or not greater than 10 microns.

Embodiment 137. The method of embodiments 74, 75, and 76, wherein the porosity comprises an average pore size (D50) within a range of at least 10 microns and not greater than 1000 microns.

Embodiment 138. The method of embodiments 74, 75, and 76, wherein the body comprises a porosity of at least 20 vol % for a total volume of the body or at least 25 vol % or at least 30 vol % or at least 35 vol % or at least 40 vol % or at least 45 vol % or at least 50 vol % or at least 55 vol % or at least 60 vol % or at least 65 vol % or at least 70 vol % or at least 75 vol % or at least 80 vol %.

Embodiment 139. The method of embodiments 74, 75, and 76, wherein the body comprises a porosity of not greater than 95 vol % for a total volume of the body or not greater than 90 vol % or not greater than 85 vol % or not greater than 80 vol % or not greater than 75 vol % or not greater than 70 vol % or not greater than 65 vol % or not greater than 60 vol % or not greater than 55 vol % or not greater than 50 vol % or not greater than 45 vol % or not greater than 40 vol % or not greater than 35 vol % or not greater than 30 vol %.

Embodiment 140. The method of embodiments 74, 75, and 76, wherein the body comprises a porosity within a range of at least 20 vol % and not greater than 95 vol % for a total volume of the body.

Embodiment 141. The method of embodiments 74, 75, and 76, wherein at least a portion of the total porosity is open porosity, wherein the open porosity defines interconnected channels extending through the body.

Embodiment 142. The method of embodiment 141, wherein the body comprises at least 10 vol % open porosity for a total content of the porosity in the body or at least 15 vol % or at least 20 vol % or at least 30 vol % or at least 40 vol % or at least 50 vol % or at least 60 vol % or at least 70 vol % or at least 80 vol % or at least 90 vol % or wherein essentially all of the porosity is open porosity.

Embodiment 143. The method of embodiment 141, wherein the body comprises not greater than 95 vol % open porosity for a total content of the porosity in the body or not greater than 90 vol % or not greater than 80 vol % or not greater than 70 vol % or not greater than 60 vol % or not greater than 50 vol % or not greater than 40 vol % or not greater than 30 vol % or not greater than 20 vol %.

Embodiment 144. The method of embodiments 74, 75, and 76, wherein at least a portion of the total porosity is closed porosity, wherein the closed porosity defines discrete and isolated voids contained in the bond material.

Embodiment 145. The method of embodiment 144, wherein the body comprises at least 10 vol % closed porosity for a total content of the porosity in the body or at least 15 vol % or at least 20 vol % or at least 30 vol % or at least 40 vol % or at least 50 vol % or at least 60 vol % or at least 70 vol % or at least 80 vol % or at least 90 vol % or wherein essentially all of the porosity is closed porosity.

Embodiment 146. The method of embodiment 144, wherein the body comprises not greater than 95 vol % closed porosity for a total content of the porosity in the body or not greater than 90 vol % or not greater than 80 vol % or not greater than 70 vol % or not greater than 60 vol % or not greater than 50 vol % or not greater than 40 vol % or not greater than 30 vol % or not greater than 20 vol %.

EXAMPLES

Example 1

Three sample sets (S1, S2, S3) and one comparative sample set of abrasives are made according to the following process. Mixtures were prepared according to table 1 and the procedure detailed below.

TABLE 1

| | S1 | S2 | S3 | CS1 |
|---|---|---|---|---|
| Abrasive Particles (white fused alundum) | | | | |
| Fine particles (30-100 microns) | 250 kg | 325 kg | 1000 kg | 0 kg |
| Large particles (125-350 microns) | 9750 kg | 9675 kg | 9000 kg | 10000 kg |
| Other Materials | | | | |
| Deionized water | 2900-3100 kg | 2900-3100 kg | 2900-3100 kg | 2900-3100 kg |
| Bond Precursor (Vitrium) | 2100-2300 kg | 2100-2300 kg | 2100-2300 kg | 2100-2300 kg |
| Gelling agent | 110-130 g | 110-130 g | 110-130 g | 110-130 g |
| Dispersant | 50-75 g | 50-75 g | 50-75 g | 50-75 g |
| Surfactant | 15-25 g | 15-25 g | 15-25 g | 15-25 g |
| Cationic Agent | 15-25 g | 15-25 g | 15-25 g | 15-25 g |

The gelling agent is added to the water while stirring. During mixing the mixture is heated at a gelling temperature of approximately 80-85° C. The bond precursor material is then added to the gel, followed by the dispersant, followed by the abrasive particles, followed by the surfactant, and finally the cationic agent is added last. The addition of the cationic agent initiates cross-linking and the formation of the gel. Mixing is continued in a reduced pressure atmosphere of approximately 0.5-0.99 bar to remove larger pores from the gel.

The gel is then poured into a production tool to cast a green body from the gel. During casting, no additional pressure or temperature is applied to the gel, and the gel is free cast to form the green body. The gel dries, and the green body stabilizes. It will be understood that other processes may optionally apply pressure to the gel to form the green body.

After forming the green body from the gel, the green body is fired to create a vitreous bond material from the bond precursor material. The firing schedule includes a ramp of approximately 100° C./hr from room temperature to a firing temperature of approximately 910-925° C. with a hold for approximately 8 hours under a normal atmosphere. After a suitable time at the firing temperature, the fired body is cooled with a ramp down of approximately 30° C./hr.

The abrasive article undergoes finishing to finalize the dimensions of the bonded abrasive body. Additionally, the bonded abrasive bodies had a diameter of 127 mm, a thickness of approximately 25 mm, and a volume of approximately 225 $cm^3$.

The abrasive article undergoes finishing to finalize the dimensions of the bonded abrasive body.

Hardness measurements were taken according to the following procedure. The abrasive bodies were aligned with and contacted the outlet of a sandblasting device. Fine quartz was fired at abrasive bodies with a pressure of about 15 psi for 10 seconds, forming a small crater in the abrasive body. The quartz used was AGSCO testing sand provided by AGSCO that conforms to the ASTM C-778 Standard for Graded and 20/30 Sand. The depth of the craters in mm is measured using a depth gauge. 24 total measurements were taken at different locations of the abrasive bodies. An image of a major surface of an abrasive article after hardness testing can be found in FIG. 5. 12 measurements were taken on each major surface, one at the inner diameter (ID), middle (M), and outer diameter (OD) of each quadrant of each major surface. For each sample, 2 hardness variation factors were calculated. The first hardness variation factor measures hardness variation between the first major surface and second major surface of the abrasive bodies and can be calculated via the following process:

1) Calculate the average of the hardness measurements taken on the first major surface.

2) Calculate the average of the hardness measurements taken on the second major surface.

3) Calculate the absolute value of the difference of the averages from step 1 and 2.

The second hardness variation factor measures the hardness variation throughout the entire wheel and is equal to the standard deviation of all 24 hardness measurements taken. The average hardness variation factors for each type of sample are outlined below in table 2.

TABLE 2

| Sample Set | wt % fine abrasives | Hardness variation factor 1 | Hardness variation factor 2 |
|---|---|---|---|
| S1 | 2.5% | 0.275 mm | 0.241 mm |
| S2 | 3.25% | 0.299 mm | 0.230 mm |
| S3 | 10% | 0.057 mm | 0.121 mm |
| C1 | 0% | 0.549 mm | 0.345 mm |

Example 2

A conventional sample (Sample C2) is formed according to the following process. Abrasive is weighed and mixed in a large mixer with dextrin as the binder. The contents are mixed for 5 minutes. Animal glue is then added to the mix and mixed for 3 minutes. Mixing is stopped when the animal glue wets the surface of the abrasive grain for the dextrin to coat uniformly on the surface. The bond is then added to the mix and the contents are mixed for 5 minutes till the bond uniformly coats the abrasive grain. Another round of dextrin is added to the mix to impart necessary green strength to survive the compaction step. The mix is then sieved to remove large clumps and then distributed evenly into a mold. The mold is then raked to remove air and the mix is compacted/pressed (80 tons of force applied) to the desired volume. The wheels are then dried for 12 hours at 80° C. and fired at 915° C. at a ramp rate of 100° C./hr and soaked for 8 hours. The wheel is then finished to accepted dimensions and analyzed using ultrasound technique.

The bonded abrasive wheel includes 13 vol % bond, 44 vol % abrasives and 43 vol % porosity.

Figure 6:
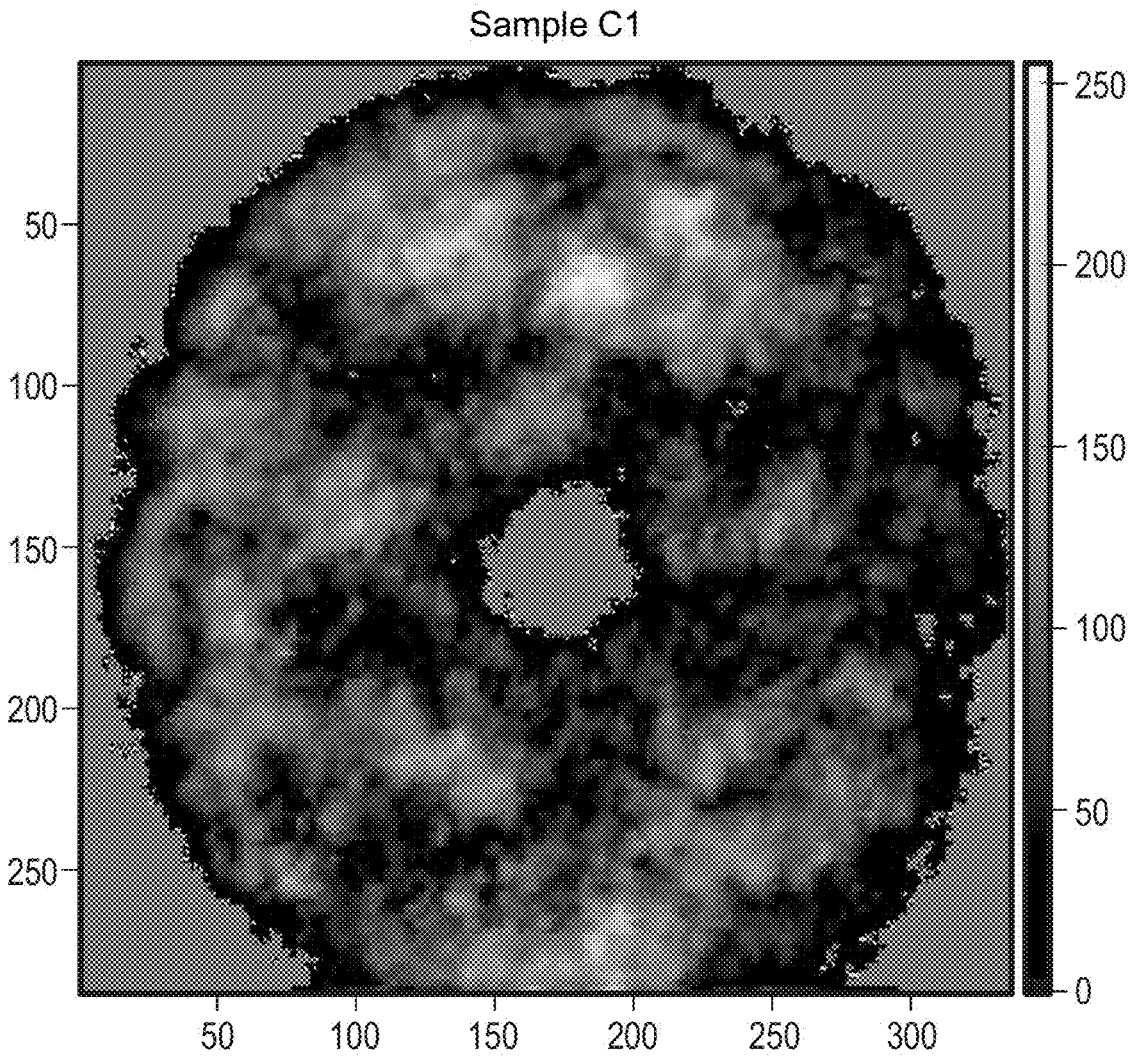
FIG. 6 includes an ultrasound image of an abrasive article.
Figure 7:
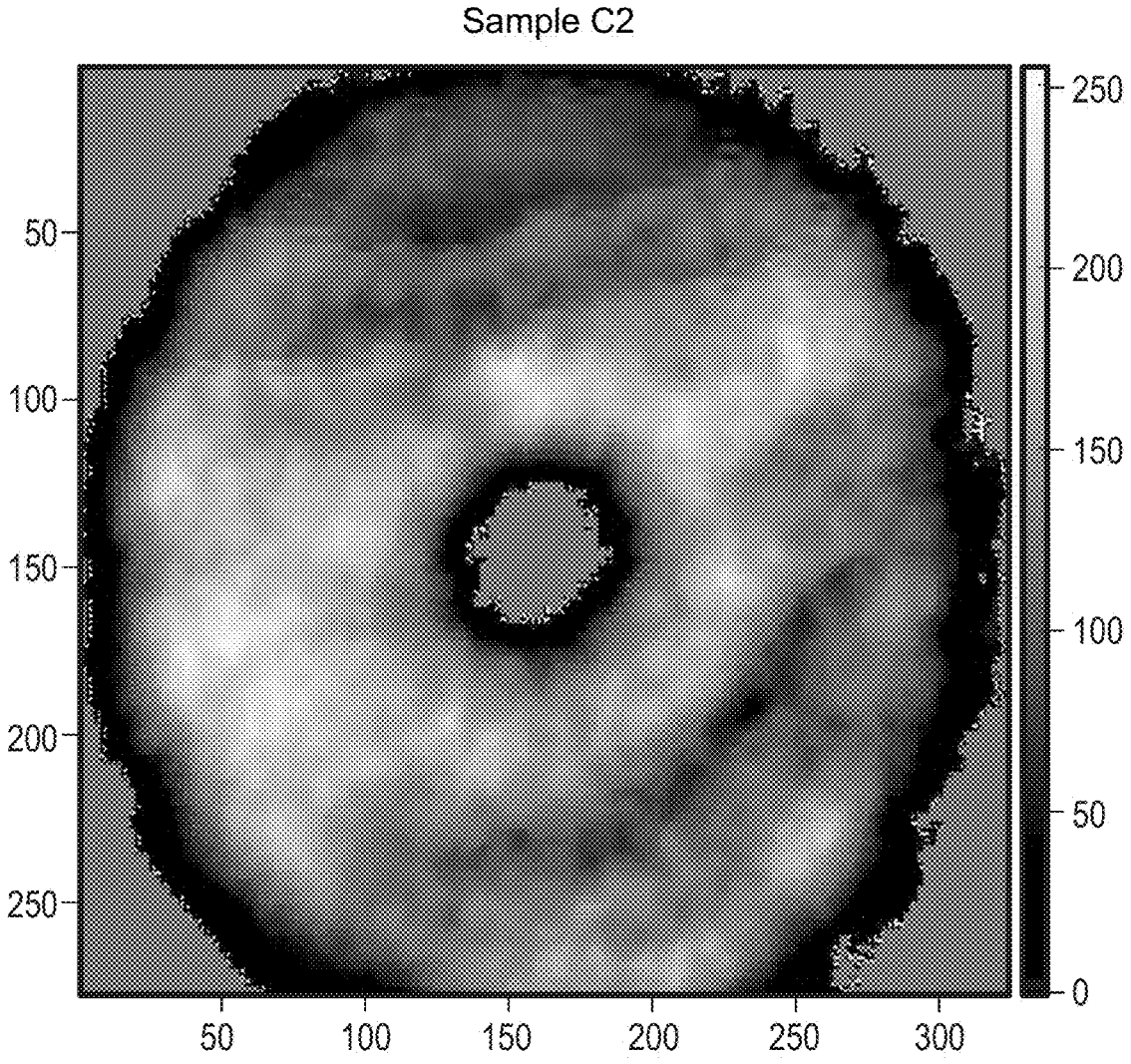
FIG. 7 includes an ultrasound image of a conventional abrasive article.

FIG. 6 includes an ultrasound image of Sample C1 used to evaluate the Homogeneity Factor. FIG. 7 includes an ultrasound image of Sample C2 used to evaluate the Homogeneity Factor. FIG. 8 includes a normalized probability plot for Samples C1 and C2 as analyzed by ultrasound for evaluation of the Homogeneity Factor. Sample C1 has a Homogeneity Factor of 62 and Sample C2 has a Homogeneity Factor of 86.

Example 3

One sample and two comparative samples were prepared according to the methods in Example 1 and the compositions in table 3 below.

TABLE 3

| | S4 | C3 | C4 |
|---|---|---|---|
| Abrasive Particles (white fused alundum) | | | |
| Fine particles | 1000 kg | 1000 kg | 1000 kg |
| Median particle size of fine particles | 45-55 microns | 30-38 microns | 70-80 microns |
| Large particles (125-350 microns) | 9000 kg | 9000 kg | 9000 kg |
| Other Materials | | | |
| Deionized water | 2900-3100 kg | 2900-3100 kg | 2900-3100 kg |
| Bond Precursor (Vitrium) | 2100-2300 kg | 2100-2300 kg | 2100-2300 kg |
| Gelling agent | 110-130 g | 110-130 g | 110-130 g |
| Dispersant | 50-75 g | 50-75 g | 50-75 g |
| Surfactant | 15-25 g | 15-25 g | 15-25 g |
| Cationic Agent | 15-25 g | 15-25 g | 15-25 g |

Figure 9:
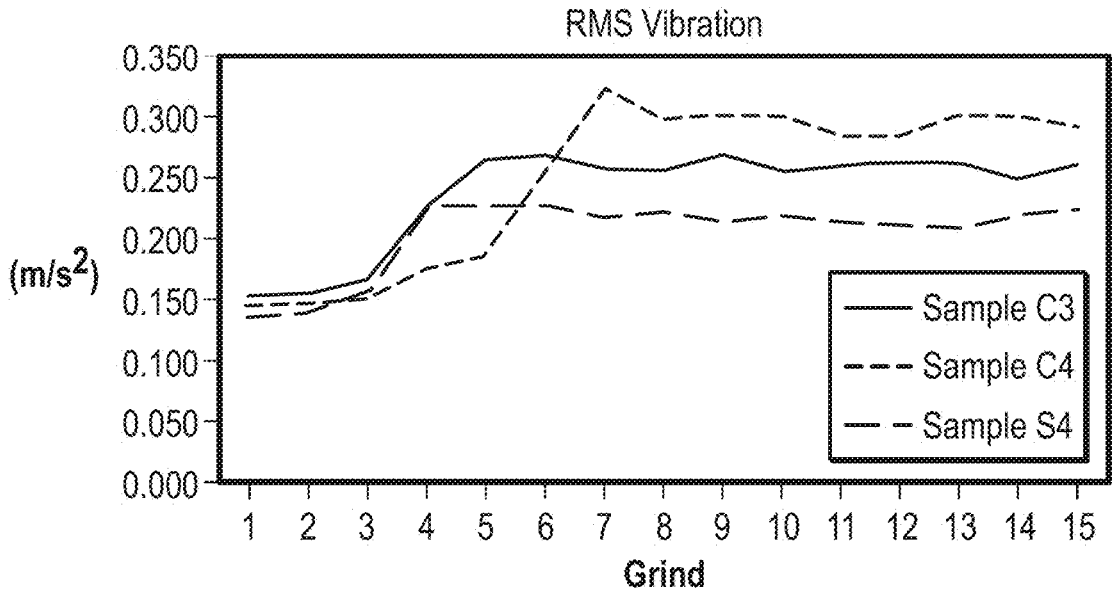
FIG. 9 includes a plot of rms vibration measurements across sequential grinds for inventive and conventional abrasive samples.
Figure 10:
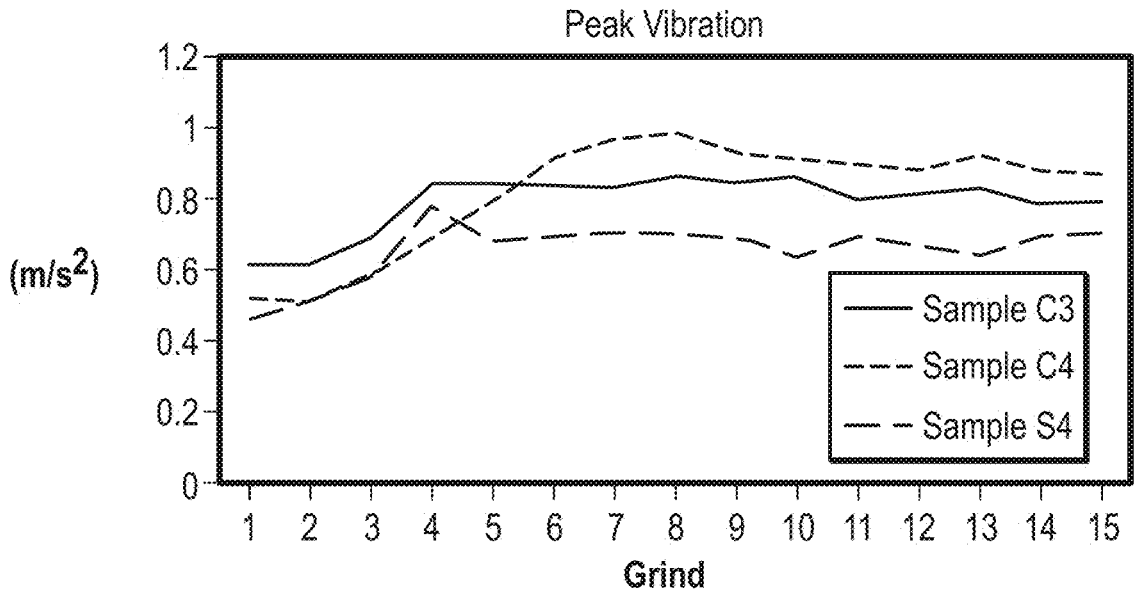
FIG. 10 includes a plot of peak vibration measurements across sequential grinds for inventive and conventional abrasive samples.

Samples S4, C3, and C4 were used to grind a work piece for 15 consecutive grinds of up to two minutes. Vibrations in the grinding machine were tracked and rms vibrations as well as peak vibrations were measured as seen in FIGS. 9 and 10, respectively.

The specification and illustrations of the embodiments described herein are intended to provide a general understanding of the structure of the various embodiments. The specification and illustrations are not intended to serve as an exhaustive and comprehensive description of all the elements and features of apparatus and systems that use the structures or methods described herein. Separate embodiments may also be provided in combination in a single embodiment, and conversely, various features that are, for brevity, described in the context of a single embodiment, may also be provided separately or in any sub-combination. Further, reference to values stated in ranges includes each and every value within that range. Many other embodiments may be apparent to skilled artisans only after reading this specification. Other embodiments may be used and derived from the disclosure, such that a structural substitution, logical substitution, or another change may be made without departing from the scope of the disclosure. Accordingly, the disclosure is to be regarded as illustrative rather than restrictive. Benefits, other advantages, and solutions to problems have been described above with regard to specific embodiments. However, the benefits, advantages, solutions to problems and any feature(s) that may cause any benefit, advantage, or solution to occur or become more pronounced are not to be construed as a critical, required, or essential feature of any or all the claims.

The description in combination with the figures is provided to assist in understanding the teachings disclosed herein. The following discussion will focus on specific implementations and embodiments of the teachings. This focus is provided to assist in describing the teachings and should not be interpreted as a limitation on the scope or applicability of the teachings. However, other teachings can certainly be used in this application.

As used herein, the terms "comprises," "comprising," "includes," "including," "has," "having" or any other variation thereof, are intended to cover a non-exclusive inclusion. For example, a method, article, or apparatus that comprises a list of features is not necessarily limited only to those features but may include other features not expressly listed or inherent to such method, article, or apparatus. Further, unless expressly stated to the contrary, "or" refers to an inclusive-or and not to an exclusive-or. For example, a condition A or B is satisfied by any one of the following: A is true (or present), and B is false (or not present), A is false (or not present), and B is true (or present), and both A and B are true (or present)

Also, the use of "a" or "an" is employed to describe elements and components described herein. This is done merely for convenience and to give a general sense of the scope of the invention. This description should be read to include one or at least one and the singular also includes the plural, or vice versa, unless it is clear that it is meant otherwise. For example, when a single item is described herein, more than one item may be used in place of a single item. Similarly, where more than one item is described herein, a single item may be substituted for that more than one item.

Unless otherwise defined, all technical and scientific terms used herein have the same meaning as commonly understood by one of ordinary skill in the art to which this invention belongs. The materials, methods, and examples are illustrative only and not intended to be limiting. To the extent not described herein, many details regarding specific materials and processing acts are conventional and may be found in reference books and other sources within the structural arts and corresponding manufacturing arts.

The above-disclosed subject matter is to be considered illustrative, and not restrictive, and the appended claims are intended to cover all such modifications, enhancements, and other embodiments, which fall within the true scope of the present invention. Thus, to the maximum extent allowed by law, the scope of the present invention is to be determined by the broadest permissible interpretation of the following claims and their equivalents and shall not be restricted or limited by the foregoing detailed description.

What is claimed is:

1. A method of making an abrasive article comprising:
forming a mixture comprising abrasive particles, a bond precursor material and a gelling agent;
forming a bonded abrasive body from the mixture, wherein the bonded abrasive body comprises:
abrasive particles contained within the bond material;
wherein the abrasive particles have a particle size distribution defining a multimodal distribution having a first mode and a second mode, wherein the particle size of the first mode, Sab1 is smaller than the particle size of the second mode Sab2, wherein Sab1 is at least 1% and no greater than 80% of Sab2, and wherein the abrasive article comprises a Hardness Variation Factor 1 (HVE1) within a range of at least 0.001 mm and not greater 0.20 mm.

2. The method of claim 1, wherein the abrasive article comprises a Hardness Variation Factor 2 (HVF2) of at least 0.005 mm and no greater than 0.20 mm.

3. The method of claim 1, wherein the abrasive article comprises a Hardness Variation Factor 1 (HVF1) of at least 0.005 mm and no greater than 0.18 mm.

4. The method of claim 1, wherein the difference between Sab1 and Sab2 is at least 10 microns and no greater than 300 microns.

5. The method of claim 4, wherein the difference between Sab1 and Sab2 is at least 50 microns no greater than 250 microns.

6. The method of claim 1, wherein the particle size distribution includes SabAVG, an average of Sab1 and Sab2, wherein SabAVG is at least 90 microns.

7. The method of claim 1, wherein the particle size distribution includes SabAVG, an average of Sab1 and Sab2, wherein SabAVG is no greater than 250 microns.

8. The method of claim 1, wherein the particle size distribution includes SabAVG, an average of Sab1 and Sab2, and wherein abrasive particles comprise a first set of abrasive particles having a particle size of at least SabAVG and a wt % Wab1 relative to the total weight of abrasive particles, and a second set of abrasive particles having a particle size of no greater than SabAVG and a wt % Wab2 relative to the total weight of the abrasive particles, and wherein Wab1/Wab2 is at least 0.020.

9. The method of claim 1, wherein the particle size distribution includes SabAVG, an average of Sab1 and Sab2, wherein the abrasive particles comprise a first set of abrasive particles having a particle size of at least SabAVG and a wt % Wab1 relative to the total weight of abrasive particles, wherein Wab1 is at least 1%.

10. The method of claim 1, wherein the particle size distribution includes SabAVG, an average of Sab1 and Sab2, wherein the abrasive particles comprise a second set of abrasive particles having a particle size no greater than SabAVG and a wt % Wab2 relative to the total weight of abrasive particles, wherein Wab2 is at least 50%.

11. The method of claim 1, wherein the first mode Sab1 is at least 40 microns.

12. The method of claim 1, wherein the first mode Sab1 is no greater than 70 microns.

13. The method of claim 1, wherein the second mode Sab2 is at least 100 microns and no greater than 400 microns.

14. The method of claim 1, wherein the first mode has a first height SabH1 and the second mode has a second height SabH2 and SabH1/SabH2 is at least 0.75 and not greater than 10.

15. The method of claim 1, wherein the first mode has a first height SabH1 and the second mode has a second height SabH2 and SabH1/SabH2 is at least 1.25 and no greater than 10.

16. The method of claim 1, wherein Sab1 is at least 2% and not greater than 40% of Sab2.

* * * * *